US008839530B2

(12) United States Patent
Smith et al.

(10) Patent No.: US 8,839,530 B2
(45) Date of Patent: Sep. 23, 2014

(54) METHOD OF LASTING AN ARTICLE OF FOOTWEAR WITH A FLUID-FILLED CHAMBER

(75) Inventors: Mark J. Smith, Portland, OR (US); Tiffany A. Beers, Portland, OR (US); Joshua P. Heard, Happy Valley, OR (US); Taryn M. Hensley, Portland, OR (US); Klaas P. Hazenberg, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 745 days.

(21) Appl. No.: 13/085,327

(22) Filed: Apr. 12, 2011

(65) Prior Publication Data

US 2012/0260526 A1 Oct. 18, 2012

(51) Int. Cl.

| | |
|---|---|
| ***A43B 9/00*** | (2006.01) |
| ***A43B 13/20*** | (2006.01) |
| ***A43B 9/02*** | (2006.01) |
| ***A43B 13/40*** | (2006.01) |

(52) U.S. Cl.

CPC . *A43B 13/20* (2013.01); *A43B 9/02* (2013.01); *A43B 13/40* (2013.01)

USPC ..... 36/12; 36/21; 36/44; 12/142 T; 12/142 C

(58) Field of Classification Search

CPC ..... A43B 9/00; A43B 9/02; A43B 13/28; A43B 13/38

USPC ..... 36/43, 44, 29, 12, 18, 21; 12/142 T, 12/142 C

See application file for complete search history.

(56) References Cited

U.S. PATENT DOCUMENTS

| | | | | | |
|---|---|---|---|---|---|
| 1,841,058 | A | * | 1/1932 | Rosenwasser | 36/16 |
| 3,063,075 | A | * | 11/1962 | Jonas | 12/142 F |
| 3,143,812 | A | * | 8/1964 | Bittner | 36/44 |
| 3,170,178 | A | * | 2/1965 | Scholl | 12/146 R |
| 3,253,355 | A | | 5/1966 | Menken | |
| 3,984,926 | A | | 10/1976 | Calderon | |
| 4,025,974 | A | | 5/1977 | Lea et al. | |
| 4,115,934 | A | * | 9/1978 | Hall | 36/44 |
| 4,123,855 | A | * | 11/1978 | Thedford | 36/44 |
| 4,183,156 | A | | 1/1980 | Rudy | |

(Continued)

FOREIGN PATENT DOCUMENTS

| | | |
|---|---|---|
| DE | 2855268 | 7/1980 |
| WO | 0065944 | 11/2000 |

OTHER PUBLICATIONS

International Preliminary Report on Patentability (including Written Opinion of the ISA) mailed Oct. 24, 2013 in International Application No. PCT/US2012/032787.

Claims filed in EP Application No. 12782488.6 on Sep. 23, 2013.

(Continued)

*Primary Examiner* — Marie Bays

(74) *Attorney, Agent, or Firm* — Plumsea Law Group, LLC

(57) ABSTRACT

A method of manufacturing an article of footwear may include assembling at least a portion of an upper of the article of footwear, the upper having a lower perimeter edge. A lasting element is secured to the upper adjacent to the lower perimeter edge. The lasting element includes a barrier and a tensile member located within the barrier, the tensile member being secured to opposite sides of the barrier. In addition, a sole structure of the article of footwear is joined to at least one of the upper and the lasting element.

24 Claims, 27 Drawing Sheets

(56) References Cited

U.S. PATENT DOCUMENTS

| | | | | |
|---|---|---|---|---|
| 4,219,945 | A | 9/1980 | Rudy | |
| 4,287,250 | A | 9/1981 | Rudy | |
| 4,513,449 | A | 4/1985 | Donzis | |
| 4,619,055 | A | 10/1986 | Davidson | |
| 4,874,640 | A | 10/1989 | Donzis | |
| 4,906,502 | A | 3/1990 | Rudy | |
| 4,936,029 | A | 6/1990 | Rudy | |
| 5,042,176 | A | 8/1991 | Rudy | |
| 5,083,361 | A | 1/1992 | Rudy | |
| 5,134,790 | A | 8/1992 | Woitschaetzke et al. | |
| 5,245,766 | A | 9/1993 | Warren | |
| 5,285,546 | A * | 2/1994 | Haimerl | 12/142 E |
| 5,287,638 | A * | 2/1994 | Preston | 36/28 |
| 5,369,896 | A | 12/1994 | Frachey et al. | |
| 5,543,194 | A | 8/1996 | Rudy | |
| 5,572,804 | A | 11/1996 | Skaja et al. | |
| 5,630,237 | A | 5/1997 | Ku | |
| 5,713,141 | A | 2/1998 | Mitchell et al. | |
| 5,741,568 | A | 4/1998 | Rudy | |
| 5,771,611 | A | 6/1998 | Chang | |
| 5,802,739 | A | 9/1998 | Potter et al. | |
| 5,918,383 | A | 7/1999 | Chee | |
| 5,952,065 | A | 9/1999 | Mitchell et al. | |
| 5,987,781 | A | 11/1999 | Pavesi et al. | |
| 5,993,585 | A | 11/1999 | Goodwin et al. | |
| 6,013,340 | A | 1/2000 | Bonk et al. | |
| 6,029,962 | A | 2/2000 | Shorten et al. | |
| 6,041,521 | A | 3/2000 | Wong | |
| 6,082,025 | A | 7/2000 | Bonk et al. | |
| 6,098,313 | A | 8/2000 | Skaja | |
| 6,119,371 | A | 9/2000 | Goodwin et al. | |
| 6,127,010 | A | 10/2000 | Rudy | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 6,385,864 | B1 | 5/2002 | Sell, Jr. et al. | |
| 6,837,951 | B2 | 1/2005 | Rapaport | |
| 7,010,868 | B2 * | 3/2006 | Haimerl et al. | 36/12 |
| 7,070,845 | B2 | 7/2006 | Thomas et al. | |
| 7,076,891 | B2 | 7/2006 | Goodwin | |
| 7,131,218 | B2 | 11/2006 | Schindler | |
| 7,555,851 | B2 * | 7/2009 | Hazenberg et al. | 36/102 |
| 7,752,772 | B2 | 7/2010 | Hatfield et al. | |
| 2002/0121031 | A1 | 9/2002 | Smith et al. | |
| 2003/0097767 | A1 | 5/2003 | Perkinson | |
| 2004/0163280 | A1 | 8/2004 | Morris et al. | |
| 2005/0039346 | A1 | 2/2005 | Thomas et al. | |
| 2005/0097777 | A1 | 5/2005 | Goodwin | |
| 2007/0169379 | A1 | 7/2007 | Hazenberg et al. | |
| 2008/0127516 | A1 * | 6/2008 | Sessa et al. | 36/92 |
| 2009/0151093 | A1 | 6/2009 | Schindler et al. | |
| 2009/0288312 | A1 | 11/2009 | Dua | |
| 2009/0288313 | A1 | 11/2009 | Rapaport et al. | |
| 2011/0131831 | A1 | 6/2011 | Peyton et al. | |

OTHER PUBLICATIONS

International Search Report and the Written Opinion, dated Mar. 28, 2013, from PCT Application No. PCT/US2012/032787.

Voluntary Amendments filed May 27, 2014 in Chinese Patent Application No. 201280017687.9.

* cited by examiner

METHOD OF LASTING AN ARTICLE OF FOOTWEAR WITH A FLUID-FILLED CHAMBER

BACKGROUND

Articles of footwear generally include two primary elements: an upper and a sole structure. The upper may be formed from a variety of material elements (e.g., textiles, polymer sheets, foam layers, leather, synthetic leather) that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates a sockliner, a polymer foam midsole, and a rubber outsole.

A common method of manufacturing an article of footwear involves the use of a lasting process. More particularly, a majority of the upper is formed and placed around a last, which has the general shape of a foot. Various methods are then utilized to tighten the upper around the last, thereby imparting the general shape of the foot to the void within the upper. In order to tighten the upper of athletic footwear around a last, for example, a strobel material is often secured to a lower perimeter of the upper and stretched across an area of the last corresponding with a lower surface of the foot. The sole structure is then secured to the lower perimeter of the upper and the strobel material to substantially complete manufacturing.

SUMMARY

Numerous aspects and variations of a method of manufacturing an article of footwear are disclosed below. The method may include assembling at least a portion of an upper of the article of footwear, the upper having a lower perimeter edge. A lasting element is secured to the upper adjacent to the lower perimeter edge. The lasting element includes a barrier and a tensile member located within the barrier, the tensile member being secured to opposite sides of the barrier. In addition, a sole structure of the article of footwear is joined to at least one of the upper and the lasting element.

Additionally, numerous aspects and variations of an article of footwear are disclosed below. The footwear may include an upper, a chamber, and a sole structure. The upper defines a lower perimeter edge. The chamber has (a) an outer barrier formed of a polymer material that defines an interior void, (b) a flange formed from the polymer material and extending around at least a portion of the barrier, the flange being secured to the upper adjacent to the lower perimeter edge, and (c) a tensile member located within the interior void and bonded to opposite sides of the barrier. The sole structure is secured to at least one of the upper and the chamber.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
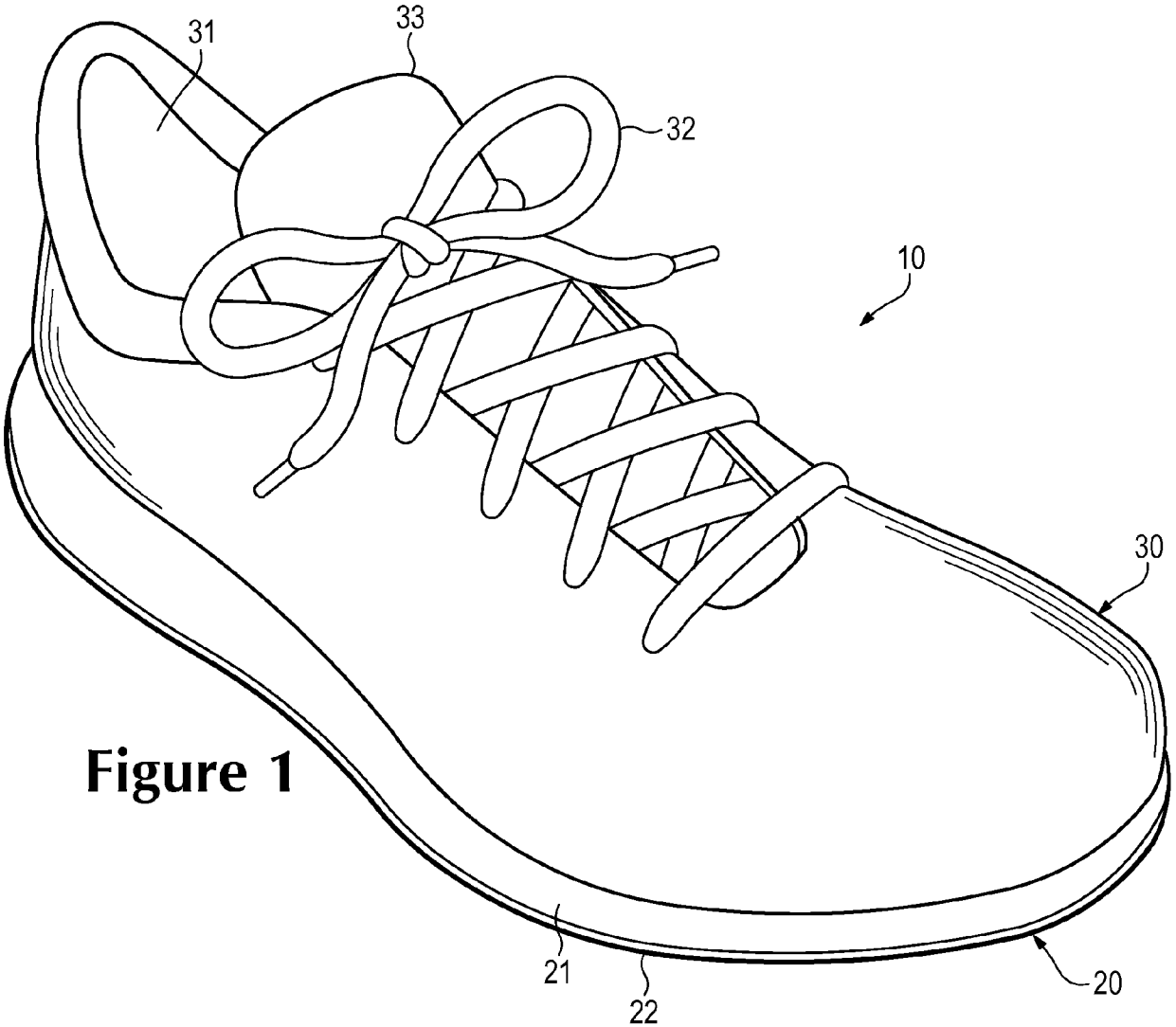
FIG. 1 is a perspective view of an article of footwear.

The following discussion and accompanying figures disclose various configurations of an article of footwear 10, as well as methods of manufacturing footwear 10. Concepts related to footwear 10 are disclosed with reference to configurations that are suitable for running, but may be utilized with a wide range of athletic footwear styles, including basketball shoes, cross-training shoes, cycling shoes, football shoes, soccer shoes, tennis shoes, and walking shoes, for example. Additionally, the concepts associated with footwear 10 may also be utilized with footwear styles that are generally considered to be non-athletic, including dress shoes, loafers, sandals, and boots. Accordingly, the concepts discussed below may apply to a variety of footwear configurations and methods of manufacturing the footwear configurations.

General Footwear Configuration

Footwear 10 is depicted in FIGS. 1-5B as including a sole structure 20 and an upper 30. For reference purposes, footwear 10 may be divided into three general regions: a forefoot region 11, a midfoot region 12, and a heel region 13. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Footwear 10 also includes a lateral side 14 and a medial side 15, which extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Sole structure 20 is secured to upper 30 and extends between the foot and the ground when footwear 10 is worn. The primary elements of sole structure 20 are a midsole 21 and an outsole 22. Midsole 21 is secured to a lower area of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate plates, moderators, fluid-filled chambers, lasting elements, or motion control members that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. A sockliner 23 may also be located within upper 30 and positioned to extend under a lower surface of the foot. In some configurations, sockliner 23 may be absent from footwear 10. Although this configuration for sole structure 20 provides an example of a sole structure that may be used in connection with upper 30, a variety of other conventional or nonconventional configurations for sole structure 20 may also be utilized. Accordingly, the configuration and features of sole structure 20 or any sole structure utilized with upper 30 may vary considerably.

Upper 30 defines a void within footwear 10 for receiving and securing a foot relative to sole structure 20. The void is shaped to accommodate the foot and extends along the lateral side of the foot, along the medial side of the foot, over the foot, around the heel, and under the foot. Access to the void is provided by an ankle opening 31 located in at least heel region 13. A lace 32 extends through various apertures or other lace-receiving elements (e.g., D-rings, hooks) in upper 30 and permits the wearer to modify dimensions of upper 30 to accommodate the proportions of the foot. More particularly, lace 32 permits the wearer to tighten upper 30 around the foot, and lace 32 permits the wearer to loosen upper 30 to facilitate entry and removal of the foot from the void (i.e., through ankle opening 31). Upper 30 also includes a tongue 33 that extends between the interior void and lace 32. In addition, for example, upper 30 may incorporate a heel counter located in heel region 13 that limits heel movement or a wear-resistant toe guard located in forefoot region 11 that imparts wear-resistance.

The various portions of upper 30 may be formed from one or more of a plurality of material elements (e.g., textiles, polymer sheets, foam layers, leather, synthetic leather) that are stitched or bonded together to form the void within footwear 10. A lower area or lower perimeter of upper 30, which is adjacent to sole structure 20 (i.e., an upper surface of midsole 21), defines an perimeter edge 34. As discussed in greater detail below, at least a portion of a lasting element 40, which is utilized in the manufacture (e.g., lasting process) of footwear 10, is secured to or located adjacent to the lower area, the lower perimeter, or perimeter edge 34.

Lasting Element Configurations

Lasting element 40 is depicted in FIGS. 6-9B as having the configuration of a fluid-filled chamber that includes a barrier 41 and a tensile member 46. In general, tensile member 46 is located within barrier 41 and secured to opposite sides of barrier 41. When barrier 41 is pressurized, tensile member 46 is placed in tension and restrains outward movement of barrier 41, thereby retaining an intended shape of lasting element 40. Fluid-filled chambers having a similar configuration are disclosed in U.S. Pat. No. 5,993,585 to Goodwin, et al.; U.S. Pat. No. 6,837,951 to Rapaport; U.S. Pat. No. 7,076,891 to Goodwin; U.S. Patent Application Publication Number 2009/0288312 to Dua; and U.S. Patent Application Publication Number 2009/0288313 to Rapaport, et al., each of which is incorporated herein by reference.

Barrier 41 forms an exterior of lasting element 40 and (a) defines an interior void that receives both a pressurized fluid and tensile member 46 and (b) provides a durable sealed barrier for retaining the pressurized fluid within lasting element 40. The polymer material of barrier 41 includes a first barrier portion 42 and an opposite second barrier portion 43 that are joined to each other with a peripheral bond 44, thereby sealing the pressurized fluid within lasting element 40. Areas of barrier portions 42 and 43 located outward of peripheral bond 44 define a flange 45 that extends around a periphery, or at least a portion of a periphery, of lasting element 40. That is, flange 45 is formed from areas of barrier portions 42 and 43 that extend beyond peripheral bond 44. Flange 45 is located, therefore, around a perimeter of barrier 41. Although the dimensions of flange 45 may vary considerably, flange 45 may extend outward from peripheral bond 45 for a distance ranging from 5 to 15 millimeters or more.

Tensile member 46 is located within the interior void and may be formed from a spacer textile (also referred to as a spacer-knit textile) that includes a pair of textile layers 47 and a plurality of connecting members 48. Whereas one of textile layers 47 is secured to an inner surface of first barrier portion 42, the other of textile layers 47 is secured to an inner surface of second barrier portion 43. Connecting members 48 are secured to textile layers 47 and space textile layers 47 apart from each other. Additionally, connecting members 48 extend between textile layers 47 and through a central area of the void formed by barrier 41. As an alternative to forming tensile member 46 from a spacer textile, other elements may be utilized within lasting element 40. For example, U.S. Pat. No. 7,131,218 to Schindler discloses a foam tensile member, and U.S. patent application Ser. No. 12/630,642 discloses a variety of tether elements that may be incorporated into a fluid-filled chamber.

In the configuration of lasting element 40 discussed above, the pressurized fluid places an outward force upon barrier 41 and tends to separate barrier portions 42 and 43 from each other. Given that tensile member 46 is located within the void formed by barrier 41 and secured to barrier portions 42 and 43, tensile member 46 effectively joins and extends between the opposite sides of barrier 41. The outward force of the pressurized fluid places connecting members 48 in tension, which restrains further outward movement of textile layers 47 and barrier portions 42 and 43. Accordingly, tensile member 46 is placed in tension by the pressurized fluid and restrains outward movement of barrier 41, thereby retaining an intended shape of lasting element 40.

In manufacturing lasting element 40, either of the general methods disclosed in U.S. Pat. No. 5,993,585 to Goodwin, et al. and U.S. Pat. No. 6,837,951 to Rapaport may be utilized, in addition to a variety of other manufacturing methods. When a thermoforming process is utilized, a pair of polymer sheets may be molded and bonded to define barrier portions 42 and 43. More particularly, the thermoforming process (a) imparts shape to one of the polymer sheets in order to form first barrier portion 42, (b) imparts shape to the other of the polymer sheets in order to form second barrier portion 43, and (c) forms peripheral bond 44 by joining the polymer sheets together. The thermoforming process may also (a) locate tensile member 46 within barrier 41 and (b) bond tensile member 46 to each of barrier portions 42 and 43. Once the thermoforming process is complete, the polymer sheets may be trimmed to form flange 45. More particularly, the polymer sheets may be trimmed in an area that is spaced from peripheral bond 44 to form flange 45.

Following the thermoforming process, a fluid may be injected into the void within barrier 41 and pressurized between zero and three-hundred-fifty kilopascals (i.e., approximately fifty-one pounds per square inch) or more. The pressurized fluid exerts an outward force upon barrier 41, which tends to separate barrier portions 42 and 43. Tensile member 46, however, is secured to each of barrier portions 42 and 43 in order to retain the intended shape of lasting element 40 when pressurized. Whereas peripheral bond 44 joins barrier portions 42 and 43 to form a seal that prevents the fluid from escaping, tensile member 46 prevents lasting element 40 from expanding outward or otherwise distending due to the pressure of the fluid. In addition to air and nitrogen, the fluid may include octafluorapropane or any of the gasses disclosed in U.S. Pat. No. 4,340,626 to Rudy, such as hexafluoroethane and sulfur hexafluoride. In some configurations, lasting element 40 may incorporate a valve or other structure that permits the pressure of the fluid to be adjusted.

A wide range of polymer materials may be utilized for barrier 41. In selecting a material for barrier 41, engineering properties of the material (e.g., tensile strength, stretch properties, fatigue characteristics, dynamic modulus, and loss tangent) as well as the ability of the material to prevent the diffusion of the fluid contained by barrier 41 may be considered. Examples of polymer materials that may be suitable for barrier 41 include thermoplastic urethane, polyurethane, polyester, polyester polyurethane, and polyether polyurethane. Barrier 41 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for barrier 41 is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and 6,321,465 to Bonk, et al.

In order to facilitate bonding between tensile member 46 and barrier 41, polymer supplemental layers may be applied to each of textile layers 47. When heated, the supplemental layers soften, melt, or otherwise begin to change state so that contact with barrier portions 42 and 43 induces material from each of barrier 41 and the supplemental layers to intermingle or otherwise join with each other. Upon cooling, therefore, the supplemental layers are permanently joined with barrier 41, thereby joining tensile member 46 with barrier 41. In some configurations, thermoplastic threads or strips may be present within textile layers 47 to facilitate bonding with barrier 41, as disclosed in U.S. Pat. No. 7,070,845 to Thomas, et al., or an adhesive may be utilized to secure barrier 41 and tensile member 46.

Based upon the above discussion, lasting element 40 has the general configuration of a fluid-filled chamber that incorporates a tensile element. This configuration imparts generally flat surfaces to lasting element 40. When the foot is located within footwear 10, therefore, the foot rests upon the generally flat surface formed by lasting element 40. Although sockliner 23 may extend between the foot and lasting element 40, the generally flat surface formed by lasting element 40 reduces pressure points and enhances the overall comfort of footwear 10. Many fluid-filled chambers that do not incorporate tensile elements utilize bonds between opposite sides of the chambers to retain the intended shape, but the bonds form a generally undulating and non-planar surface. As a result, a tensile element, such as tensile member 46, is utilized to provide a generally flat surface for supporting the foot.

Manufacturing Process

Figure 10A:
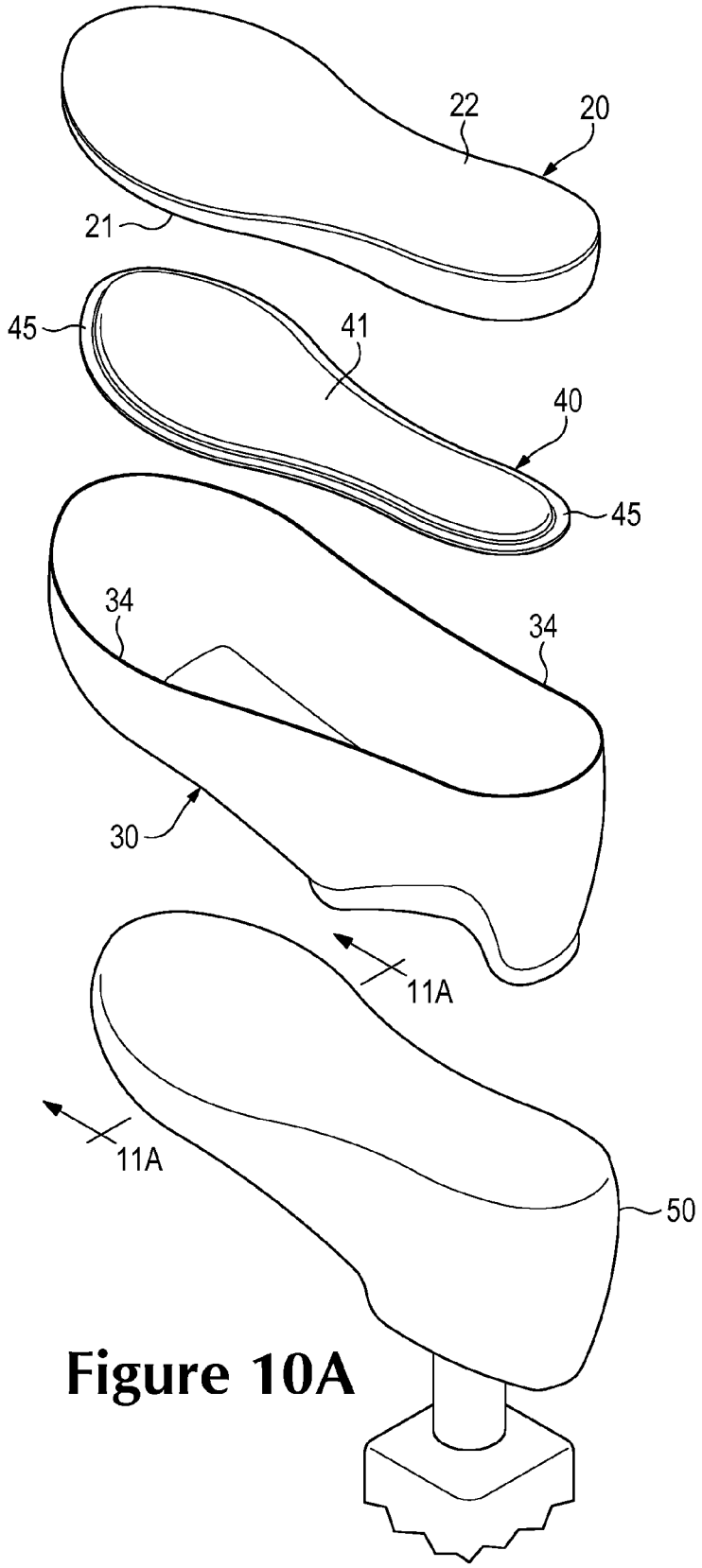
FIGS. 10A-10G are perspective views of a manufacturing process for the article of footwear.

A variety of techniques may be utilized to manufacture footwear 10. An example of a manufacturing process that incorporates the use of lasting element 40 is discussed below in relation to FIGS. 10A-10G and 11A-11F. Referring to FIG. 10A, an initial stage of the manufacturing process is shown, wherein various separate elements of footwear 10 (e.g., portions of sole structure 20, upper 30, and lasting element 40) are present and located proximal to a last 50. At this stage, upper 30 is generally assembled from various material elements (e.g., textiles, polymer sheets, foam layers, leather, synthetic leather) that are stitched or bonded together. A lower area of upper 30, which faces upward in FIG. 10A, defines perimeter edge 34.

Figure 11A:
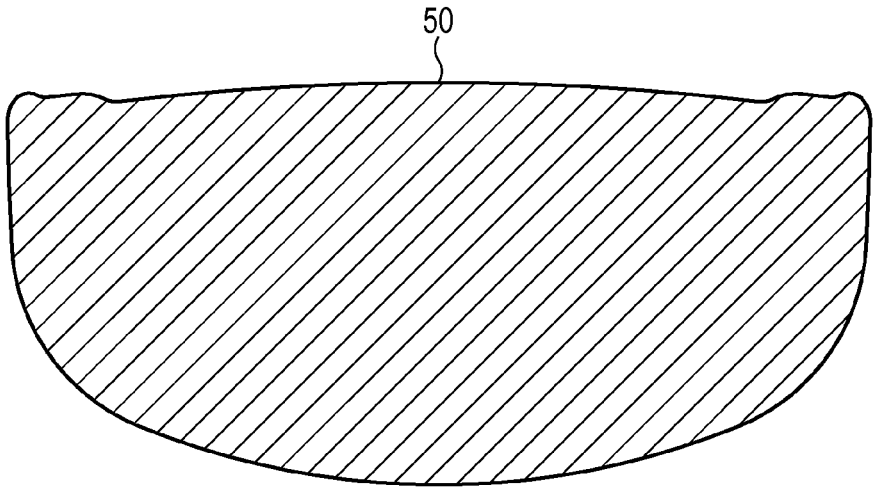
FIGS. 11A-11F are cross-sectional views of the manufacturing process, as respectively defined by section lines 11A-11F in FIGS. 10A-10F.

Last 50 may have a conventional last configuration and has the general shape of a foot, as well as portions of an ankle. As oriented in FIG. 10A, portions of last 50 corresponding with a lower surface of the foot face upwards, portions of last 50 corresponding with an upper surface of the foot face downwards, portions of last 50 corresponding with the toes face toward the upper-left, and portions of last 50 corresponding with the heel face toward the lower-right. Referring to FIG. 11A, a cross-sectional view through a portion of last 50 corresponding with a forefoot region of the foot is depicted. Although last 50 is depicted as having a solid configuration, last 50 may also be formed from multiple, movable elements that vary the overall shape of last 50.

Figure 10B:
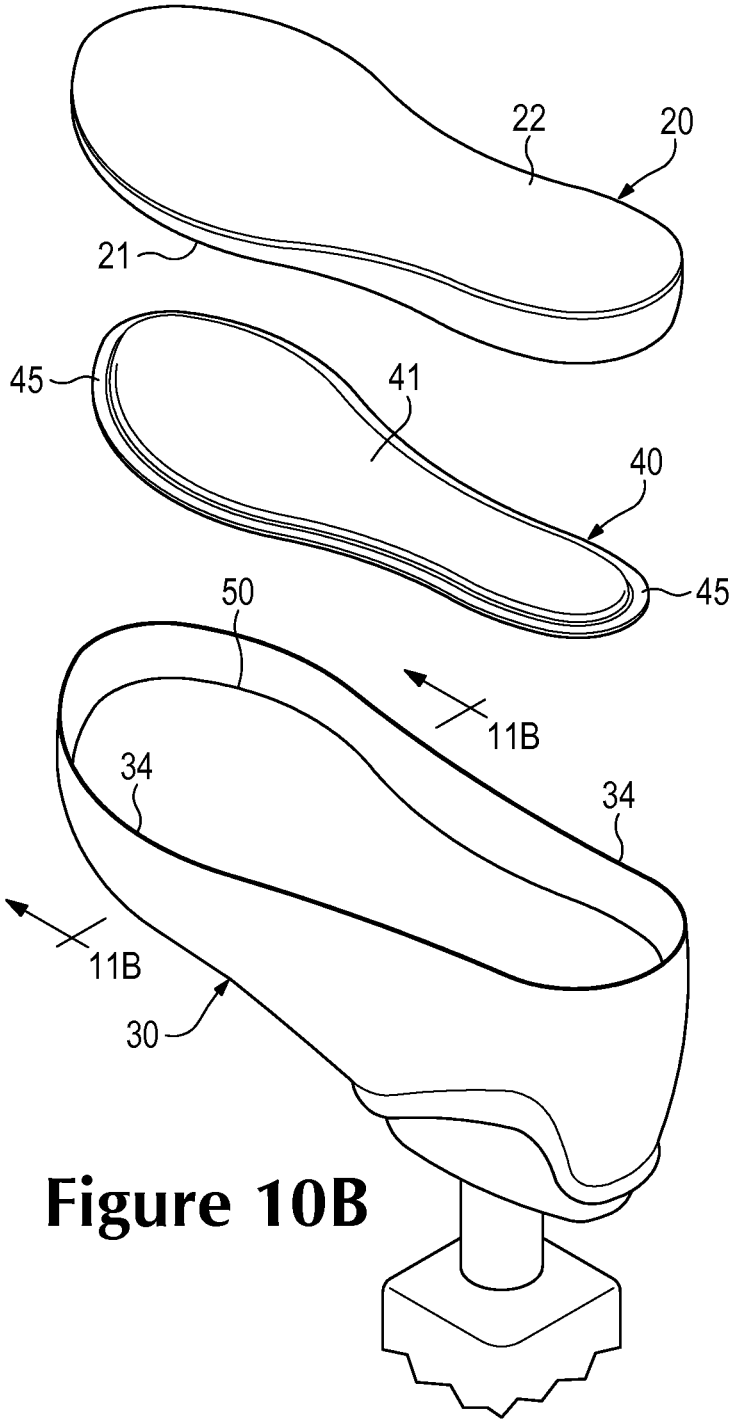
Figure 11B:
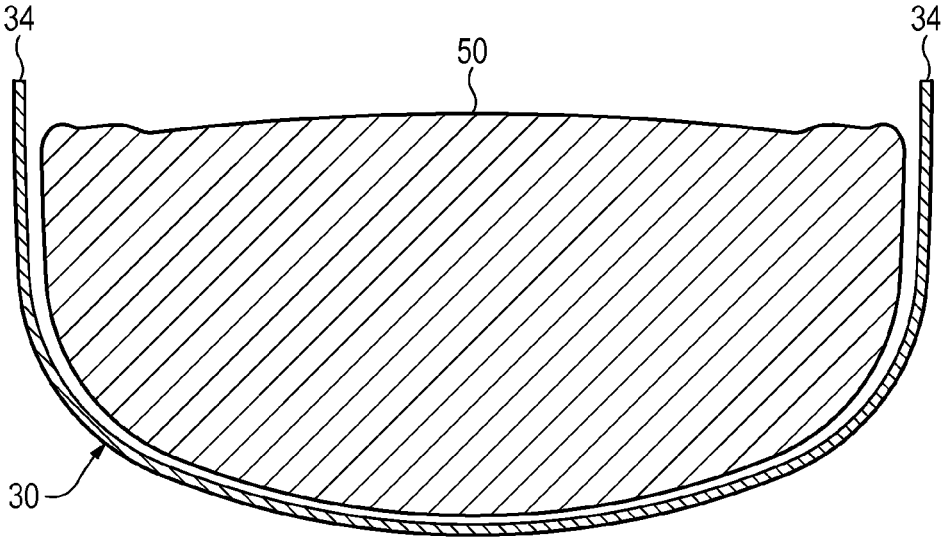

Upper 30 is now placed over last 50, as depicted in FIGS. 10B and 11B, and covers areas of last 50. More particularly, upper 30 covers portions of last 50 corresponding with the lateral and medial side of the foot, the upper surface of the foot, and the heel area of the foot. At this stage of the manufacturing process, however, portions of last 50 corresponding with the lower surface of the foot are exposed. That is, perimeter edge 34 forms an aperture or opening in upper 30 that exposes portions of last 50 corresponding with the lower surface of the foot.

Figure 10C:
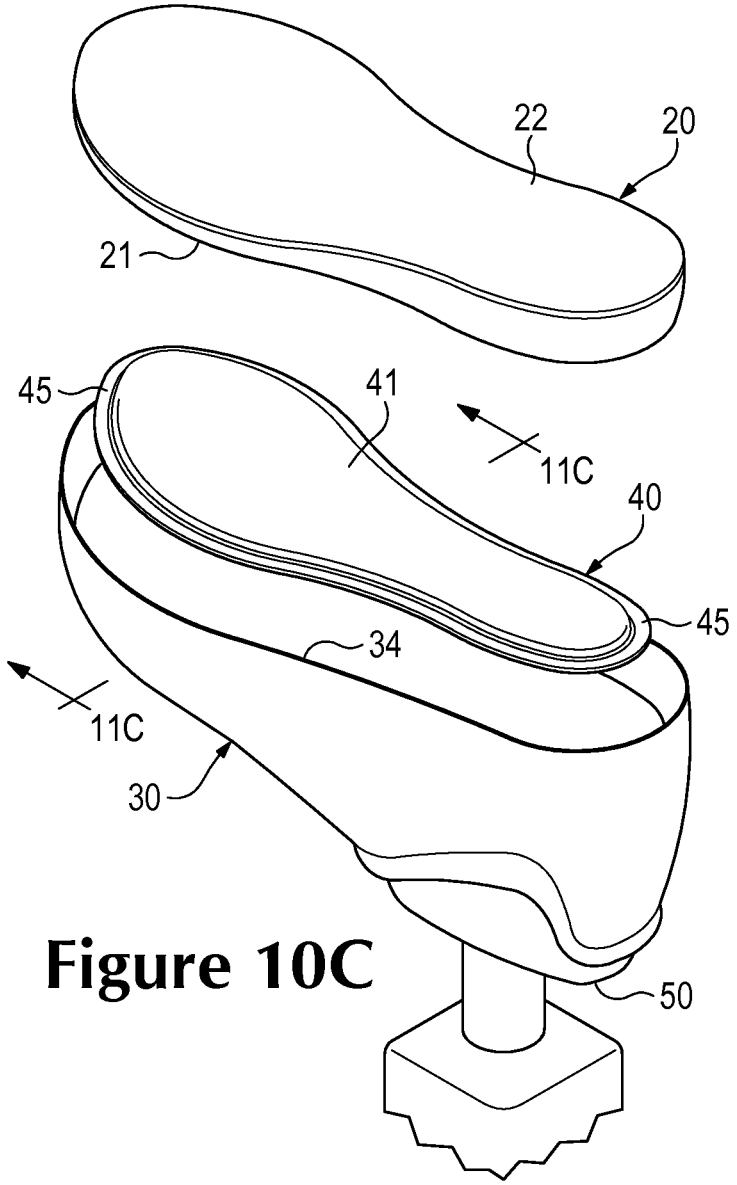
Figure 10D:
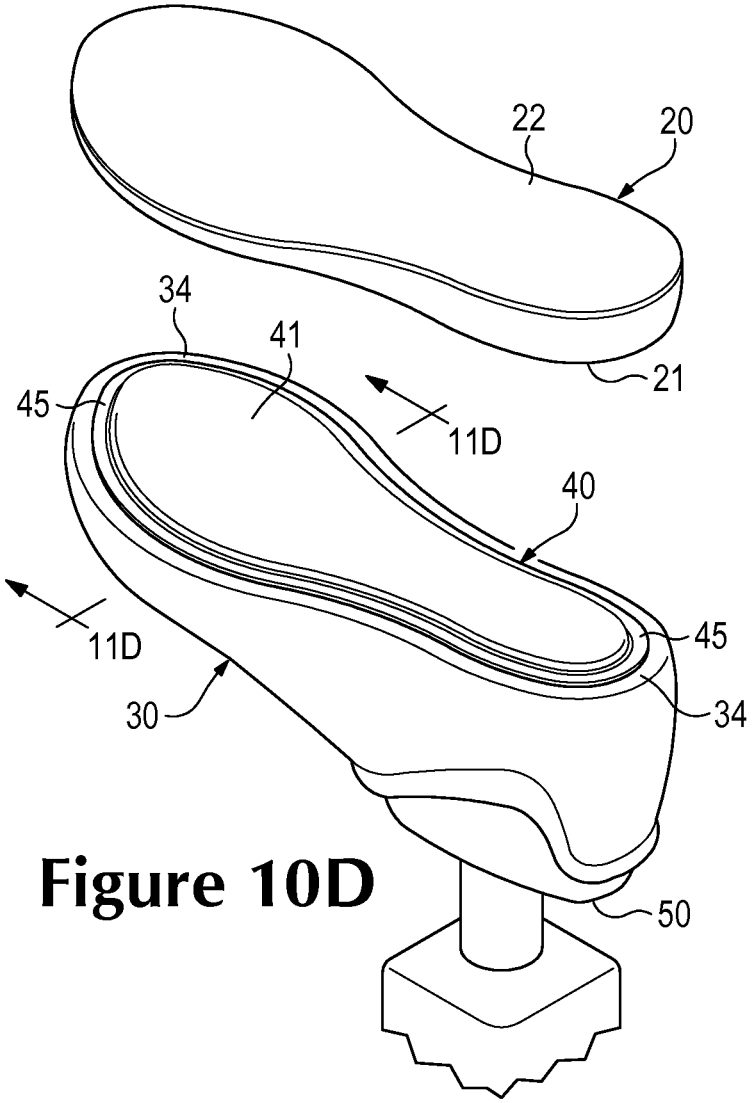
Figure 11C:
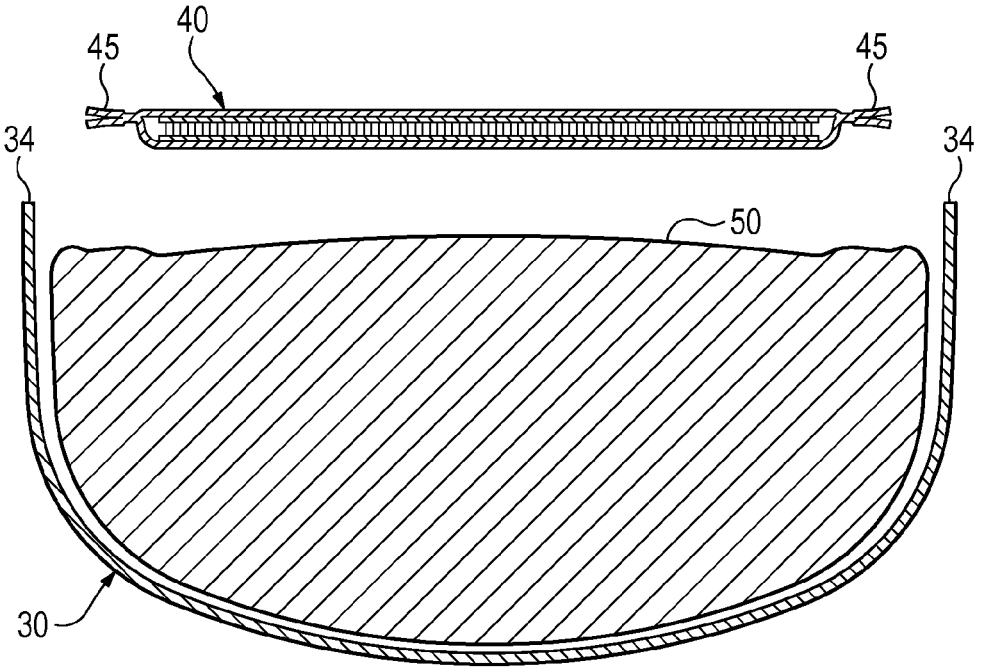
Figure 11D:
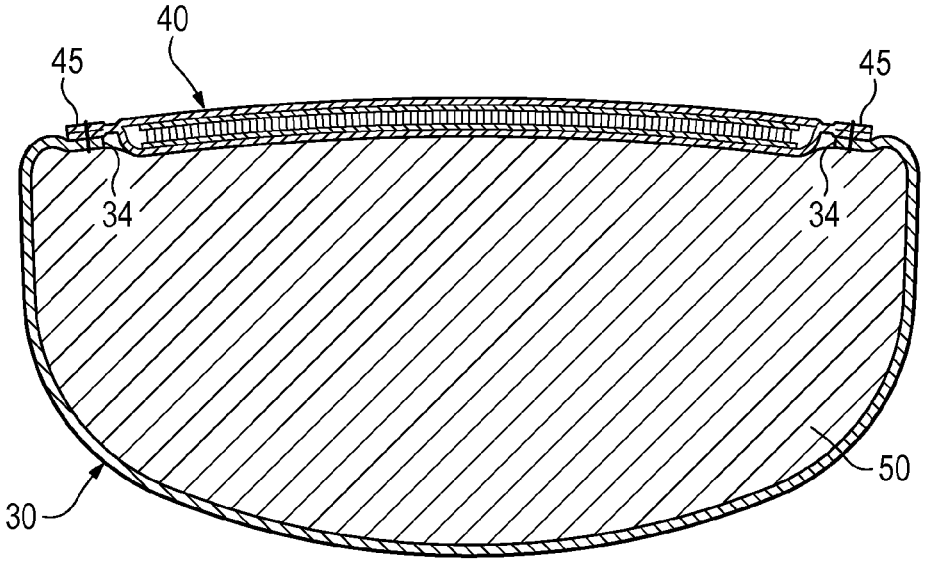

Once upper 30 is placed over last 50, lasting element 40 is located proximal to the lower area of upper 30, as depicted in FIGS. 10C and 11C. Lasting element 40 is then secured to the lower area of upper 30, as depicted in FIGS. 10D and 11D, and extends from forefoot region 11 to heel region 13. More particularly, flange 45 is secured to the lower area of upper 30 adjacent to perimeter edge 34. Although a variety of methods may be utilized to join lasting element 40 with the lower area of upper 30, stitching, thermal bonding, adhesive bonding, or a combination of these methods may each be utilized.

Figure 10E:
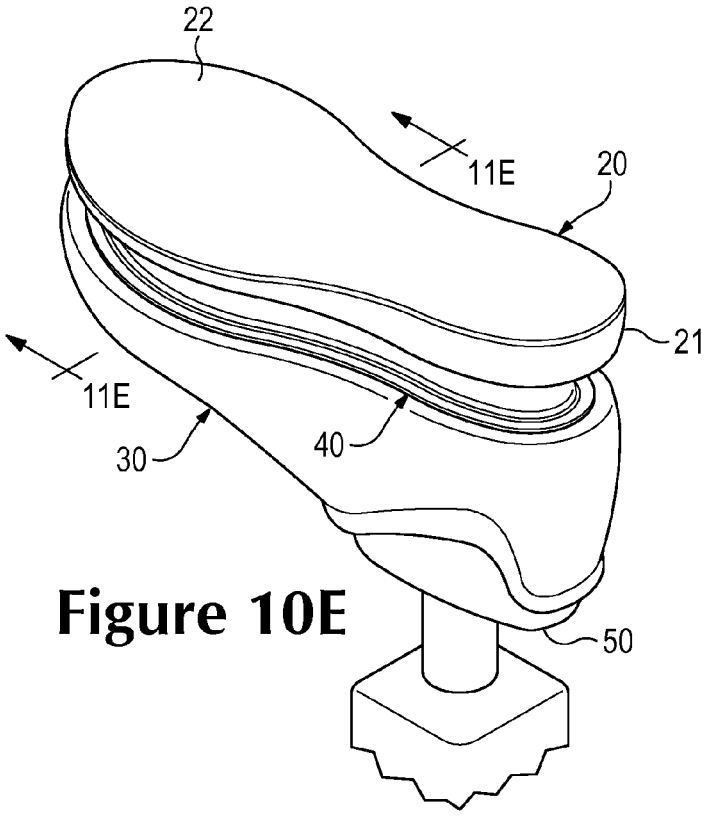
Figure 10F:
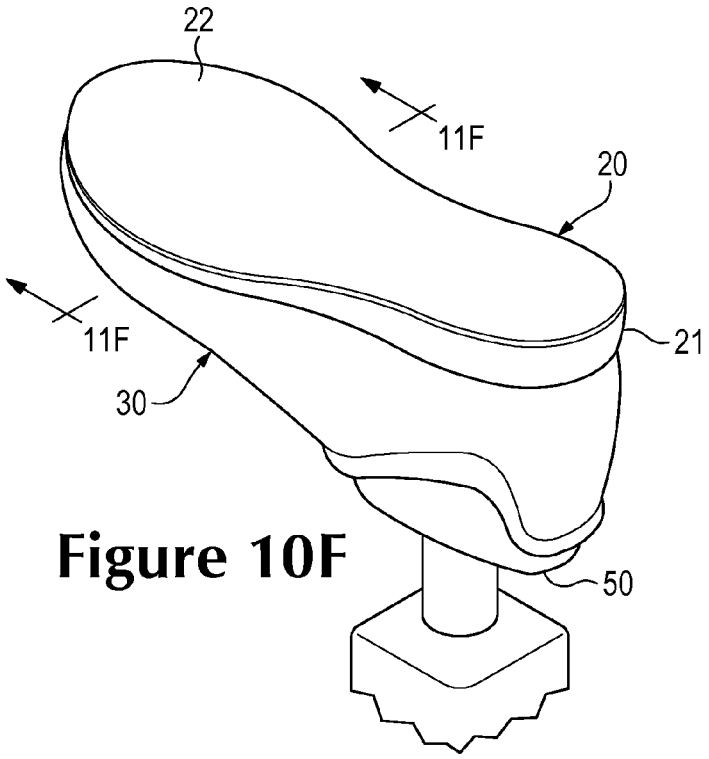
Figure 10G:
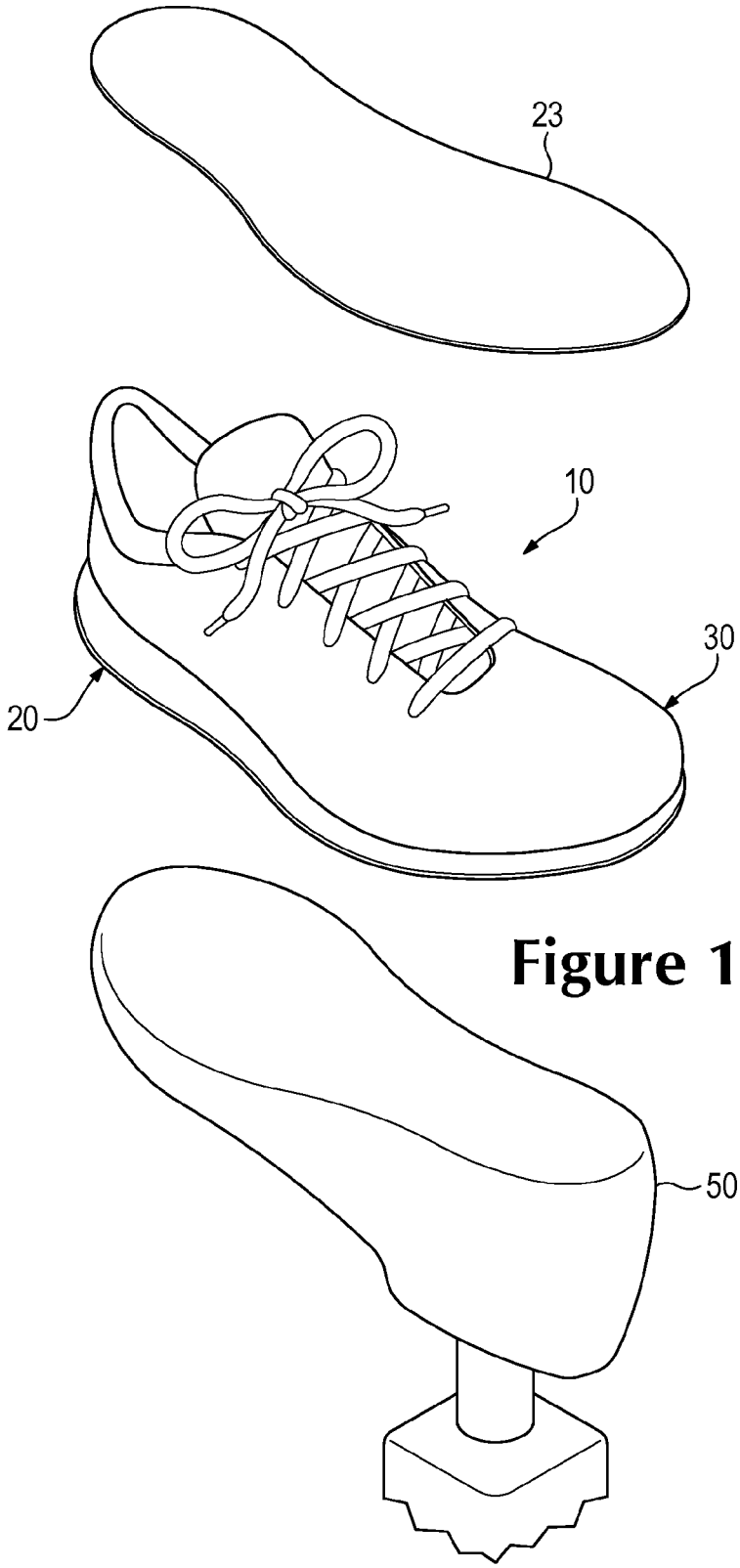
Figure 11E:
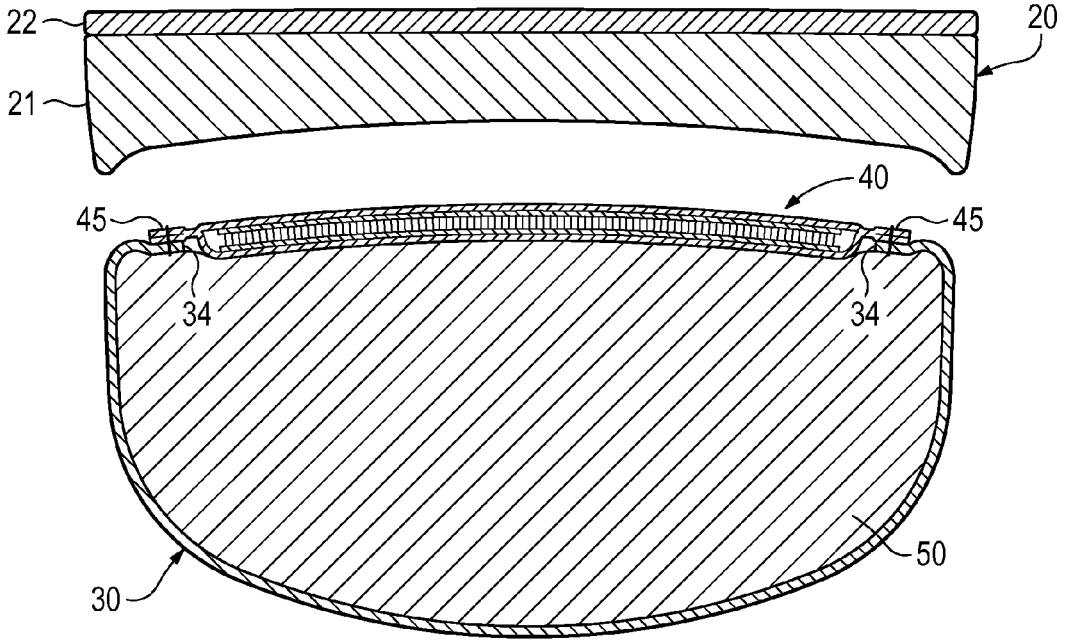
Figure 11F:
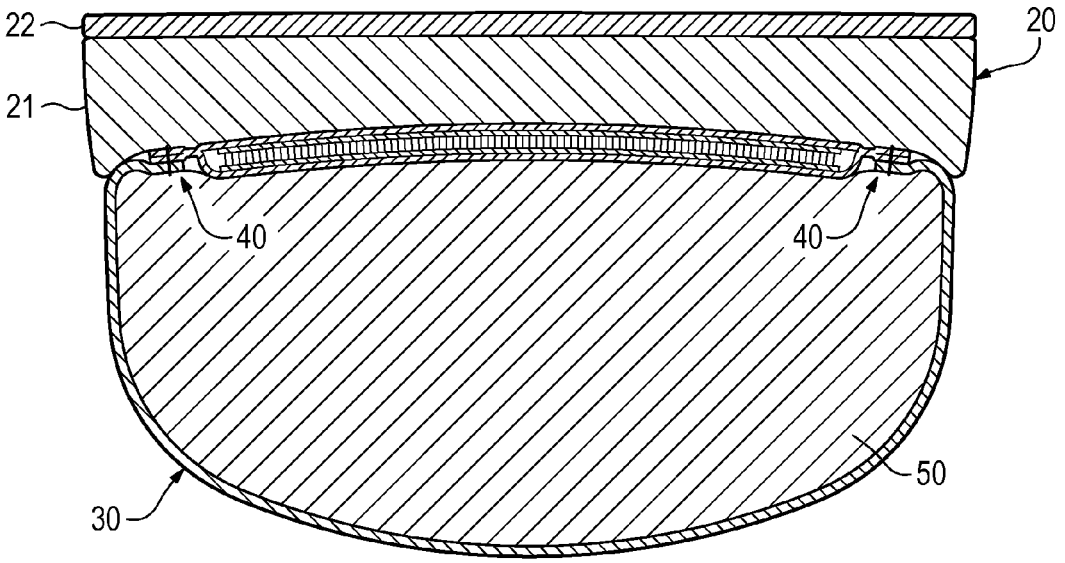

Following securing lasting element 40 to upper 30, sole structure 20 is located proximal to lasting element 40 and the lower area of upper 30, as depicted in FIGS. 10E and 11E. Sole structure 20 is then secured to lasting element 40 and/or the lower area of upper 30, as depicted in FIGS. 10F and 11F. Although a variety of methods may be utilized to join sole structure 20 with lasting element 40 and the lower area of upper 30, stitching, thermal bonding, adhesive bonding, or a combination of these methods may each be utilized. Once sole structure 20 is secured, footwear 10 may be removed from last 50, as depicted in FIG. 10G. Moreover, sockliner 23 may be placed within the void formed by upper 30 and adjacent to an upper surface of lasting element 40 to substantially complete the manufacture of footwear 10.

Based upon the above discussion, footwear 10 may be manufactured through a process that generally includes placing at least a portion of upper 30 over last 50. Lasting element 40 is then secured to upper 30. More particularly, lasting element 40 is secured to the lower area of upper 30 by securing flange 45 adjacent to perimeter edge 34. Sole structure 20 may then be secured to lasting element 40 and/or the lower area of upper 30 to substantially complete the manufacture of footwear 10.

Further Configurations

Figure 2:
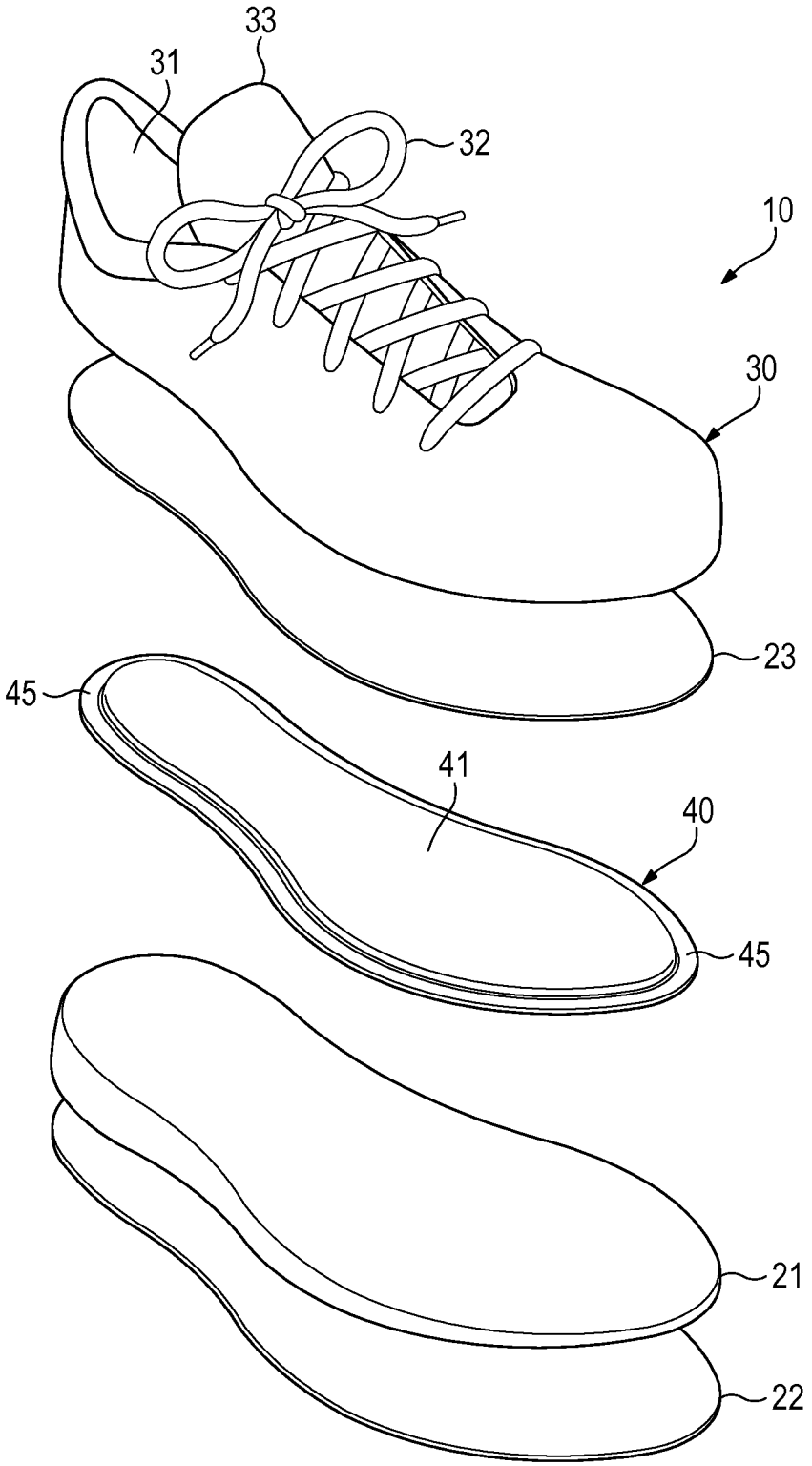
FIG. 2 is an exploded perspective view of the article of footwear.
Figure 3:
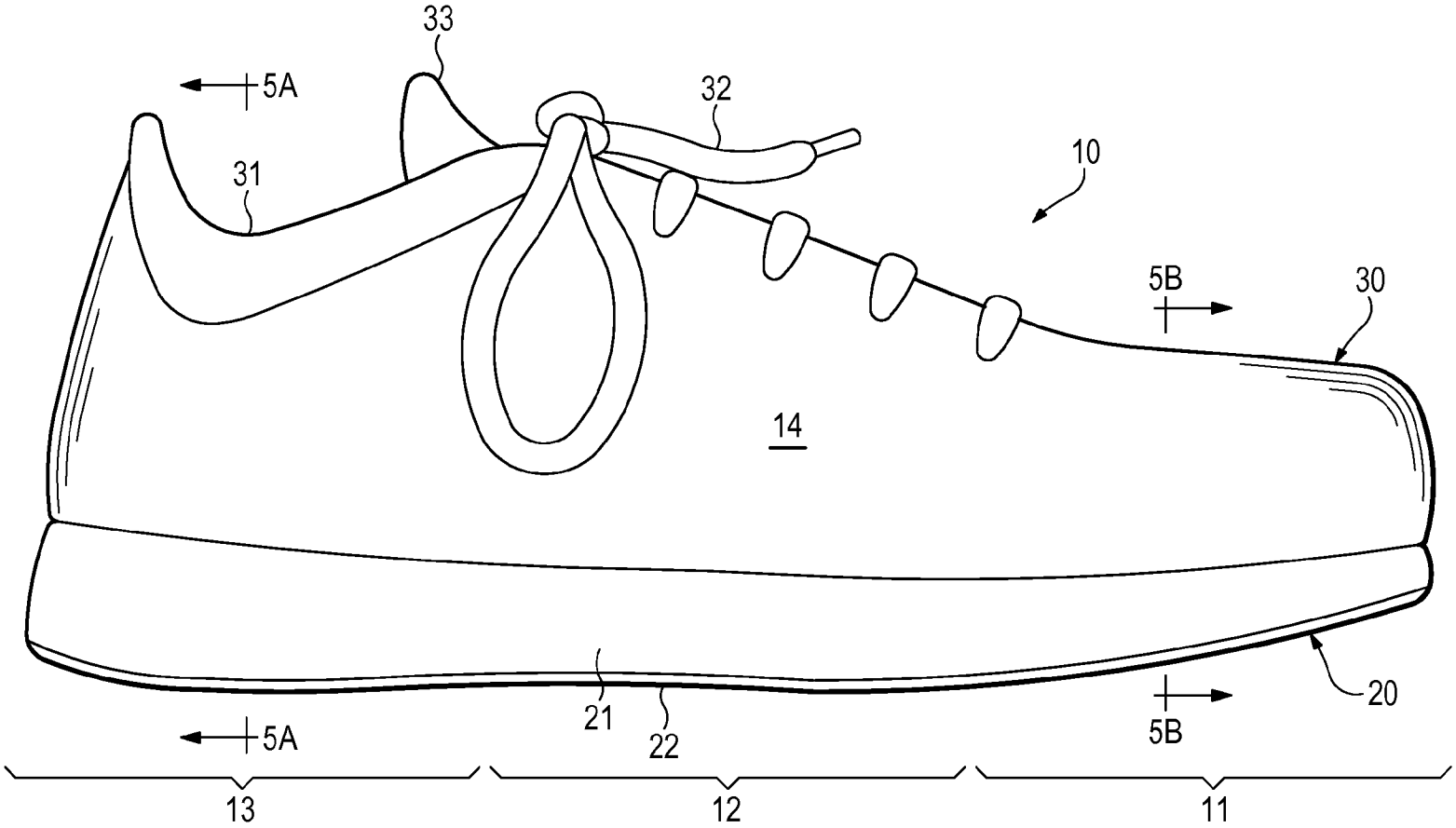
FIG. 3 is a lateral side elevational view of the article of footwear.
Figure 4:
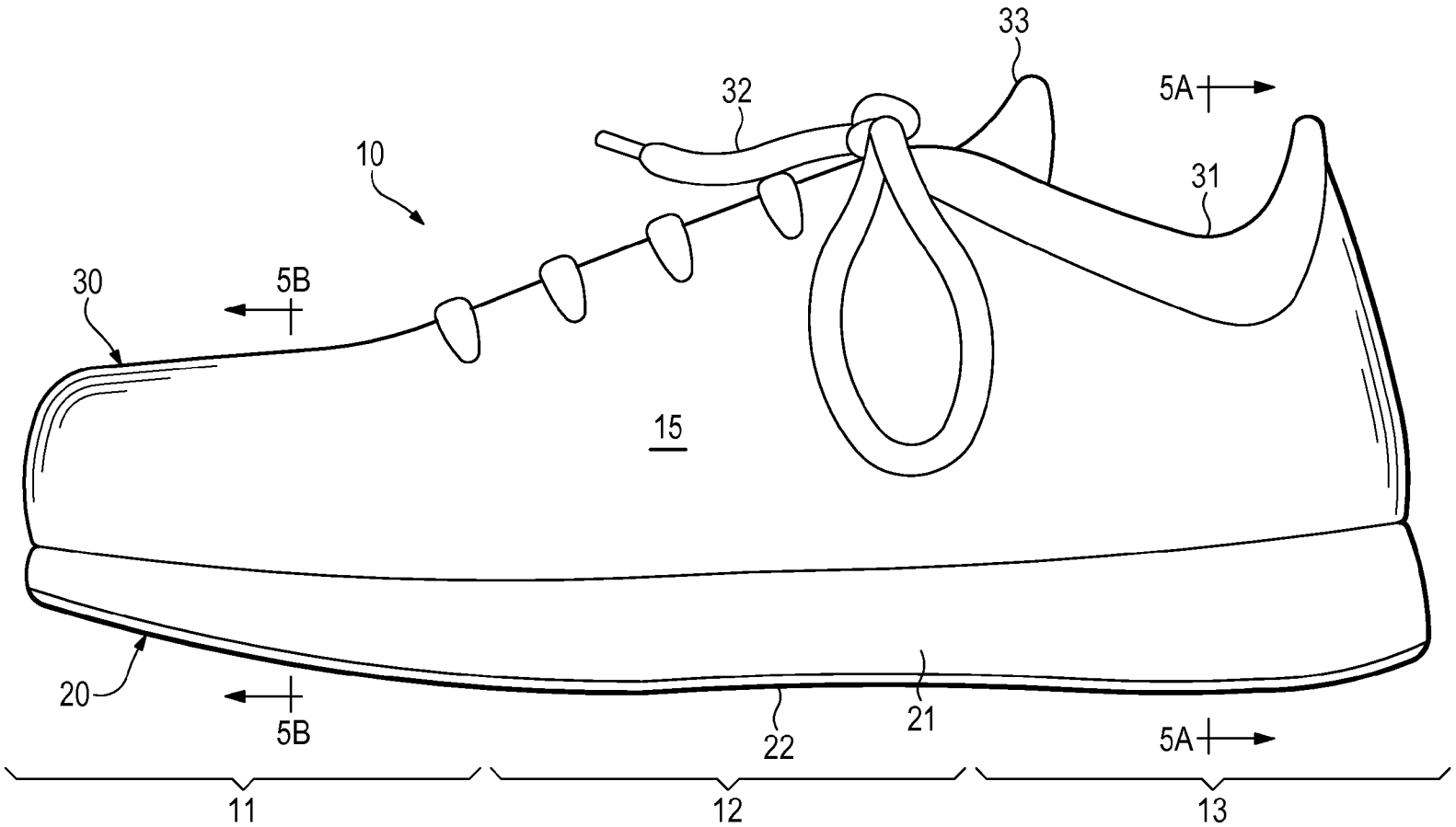
FIG. 4 is a medial side elevational view of the article of footwear.
Figure 12A:
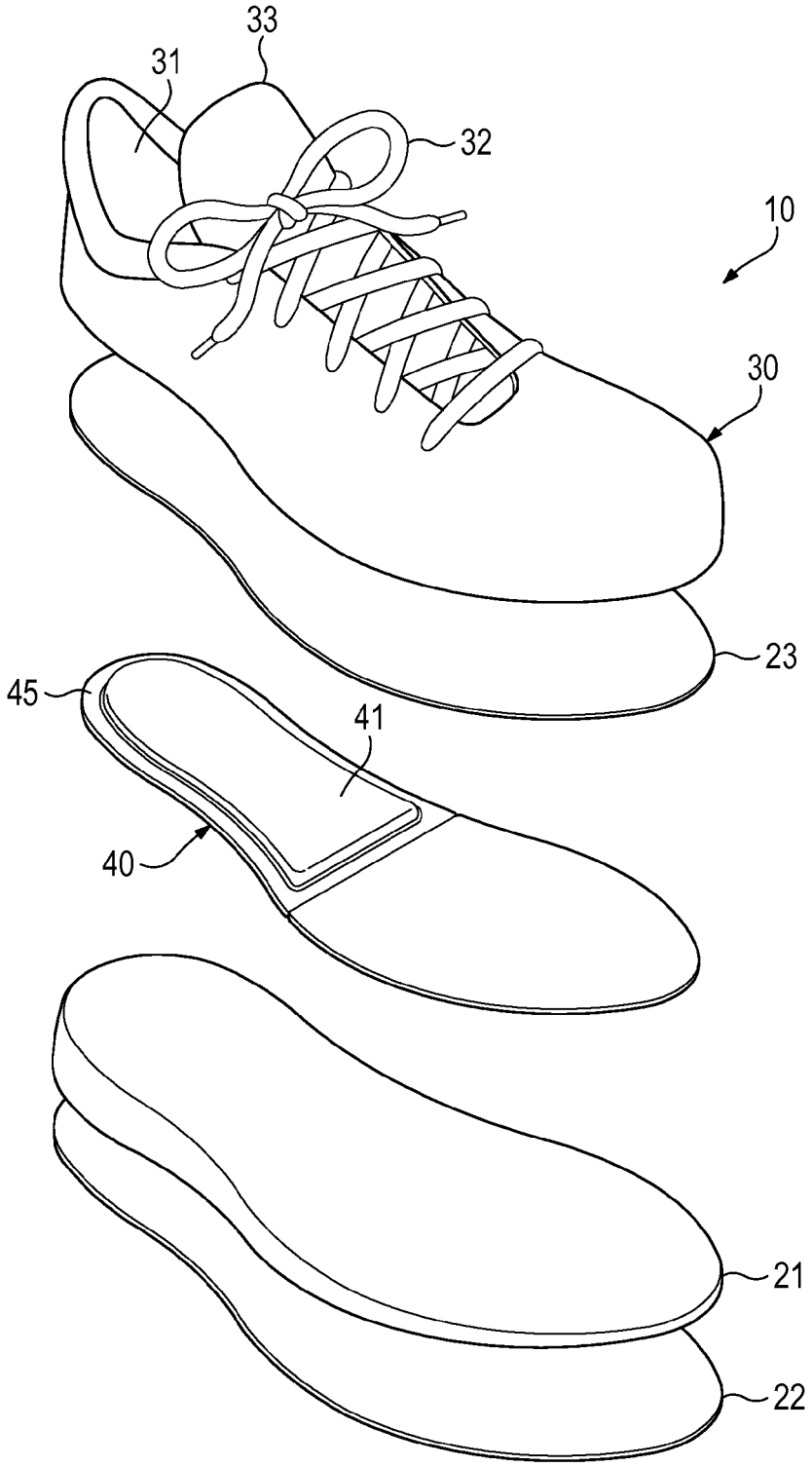
FIGS. 12A-12C are perspective views corresponding with FIG. 2 and depicting further configurations of the article of footwear.
Figure 12B:
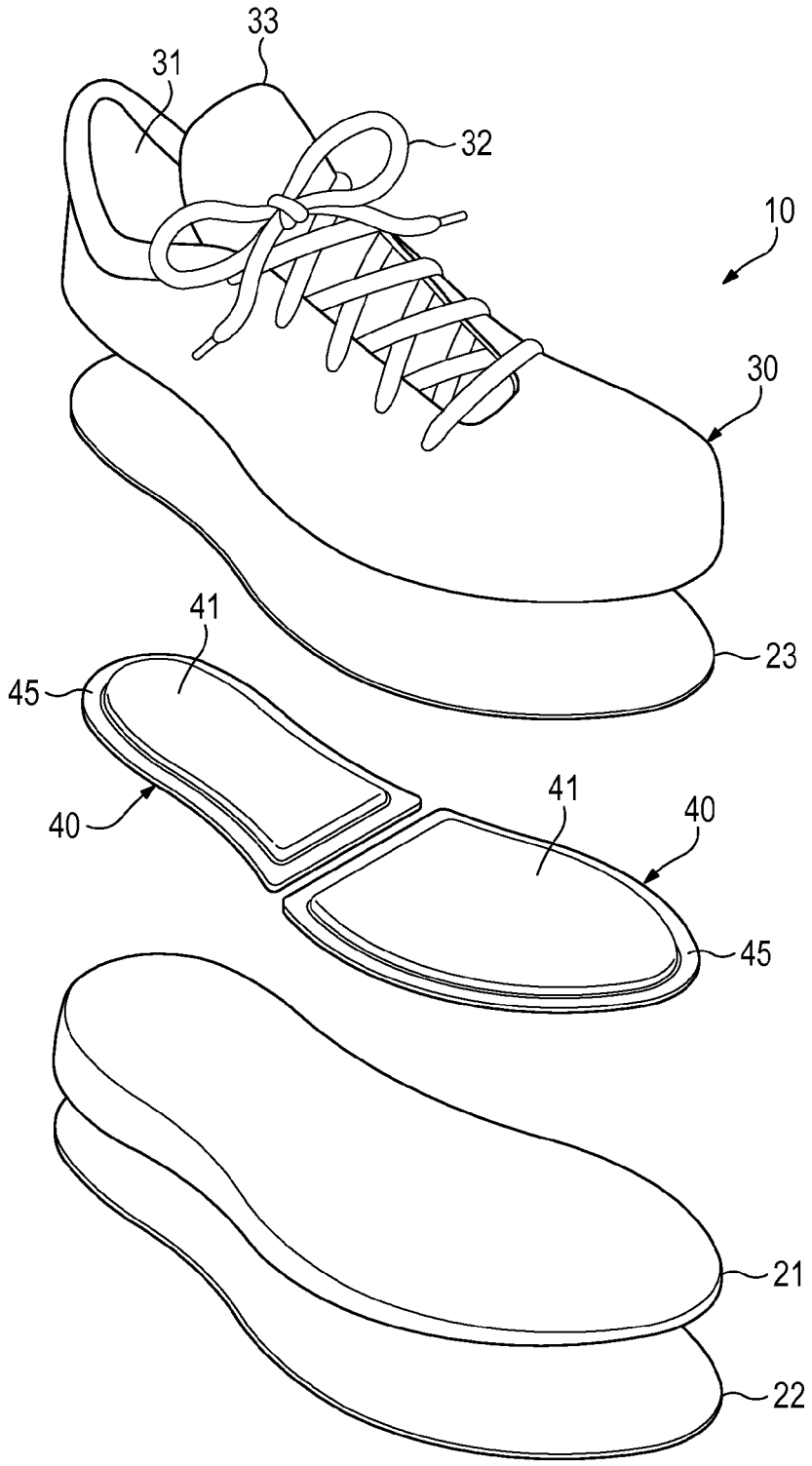
Figure 12C:
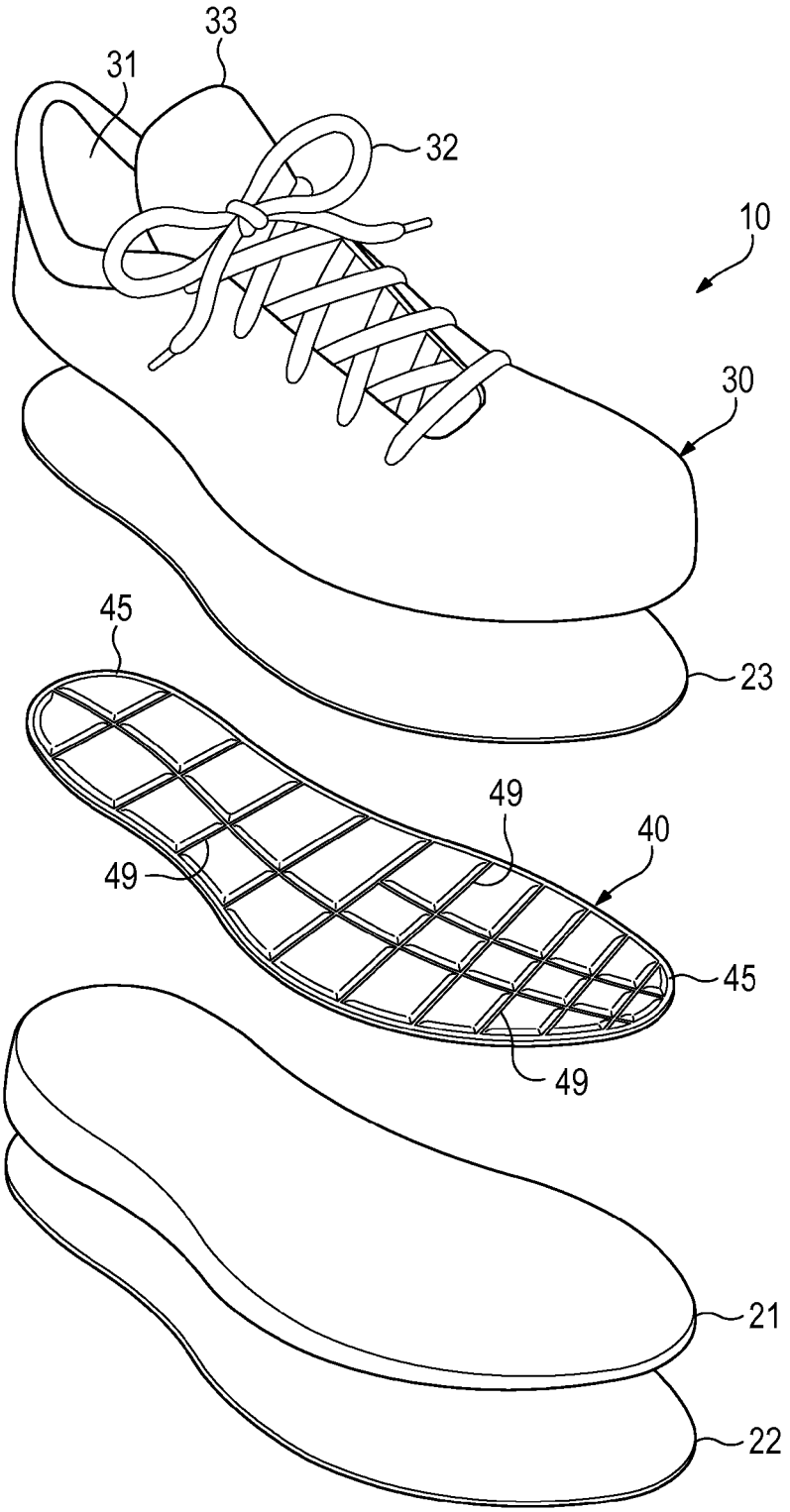

Aspects of footwear 10, including lasting element 40, and the manufacturing process for footwear 10 may vary. Referring to FIG. 2, for example, lasting element 40 has a configuration wherein barrier 41 and tensile member 46 extend throughout the length and width of footwear 10. As an alternative, FIG. 12A depicts a configuration wherein barrier 41 and tensile member 46 are located in heel region 13 and a portion of midfoot region 12 and a textile element extends forward through forefoot region 11. In a similar structure, barrier 41 and tensile member 46 are located in forefoot region 11, with a textile element extending rearward through heel region 13. The configuration of FIG. 2 also depicts lasting element 40 as being a single component. In some configurations, however, separate lasting elements 40 may be located in different areas of footwear 10. For example, FIG. 12B depicts a configuration wherein two separate lasting elements 40 are utilized. One advantage of utilizing more than one lasting element 40 is that each of the lasting elements 40 may have different properties, such as thickness and pressurization. Referring to FIG. 12C, lasting element 40 is depicted as having various bonds 49 that extend both laterally and longitudinally, which is similar to a fluid-filled chamber disclosed in U.S. Pat. No. 7,752,772 to Hatfield, et al. In addition to providing a plurality of subchambers that all enclose portions of the fluid within lasting element 40, bonds 49 impart flexibility in defined locations. That is, bonds 49 allow lasting element 40 to flex in specific locations and in specific directions.

Figure 5A:
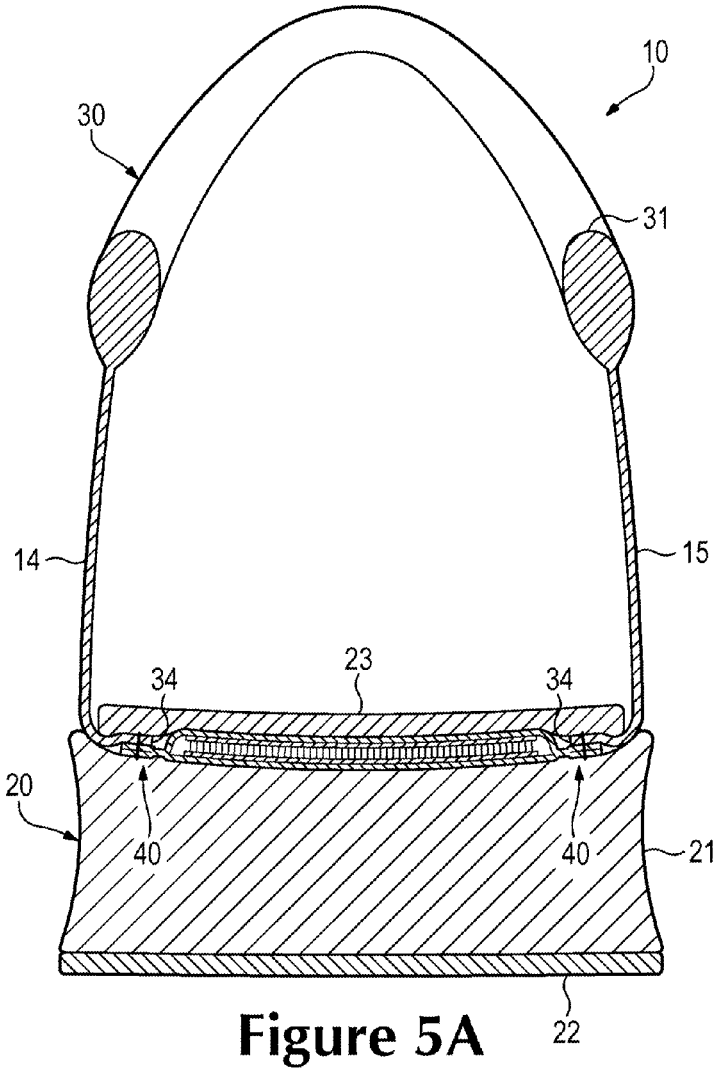
FIGS. 5A and 5B are cross-sectional views of the article of footwear, as respectively defined by section lines 5A and 5B in FIGS. 3 and 4.
Figure 5B:
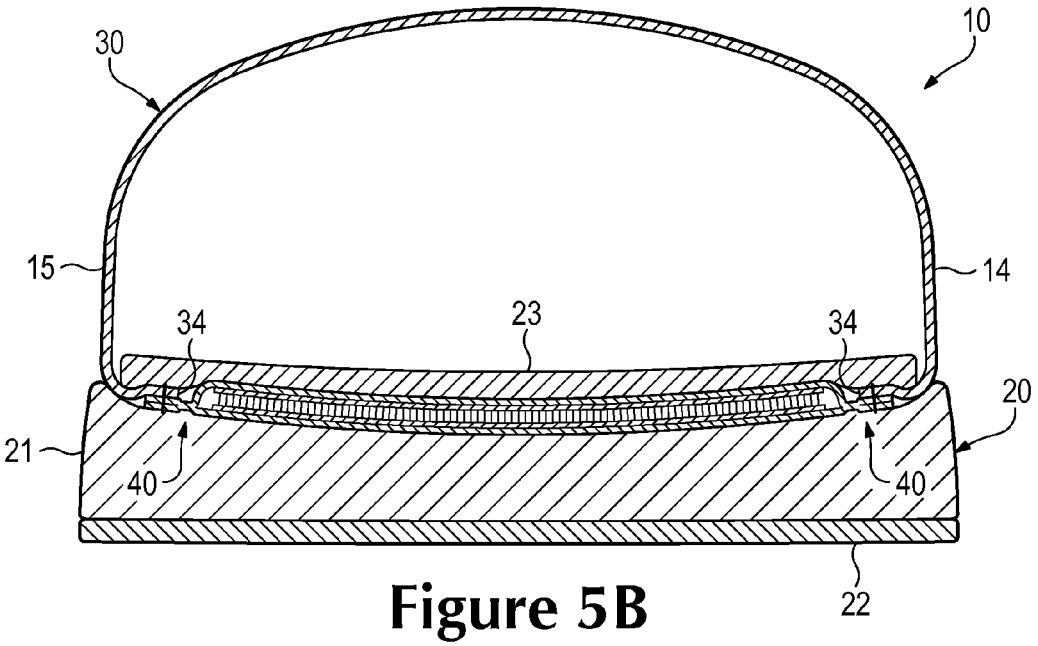
Figure 6:
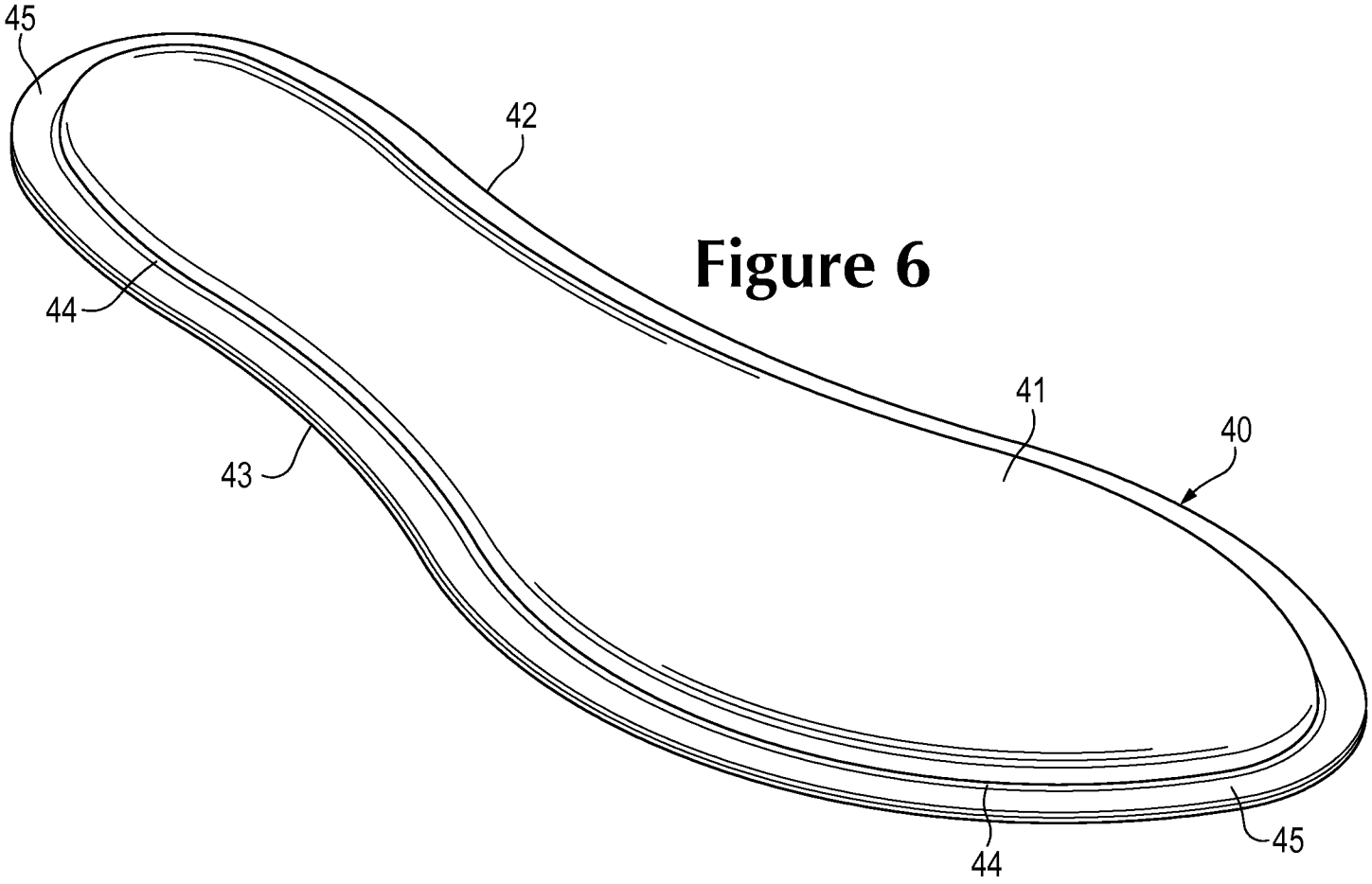
FIG. 6 is a perspective view of a lasting element of the article of footwear.
Figure 7:
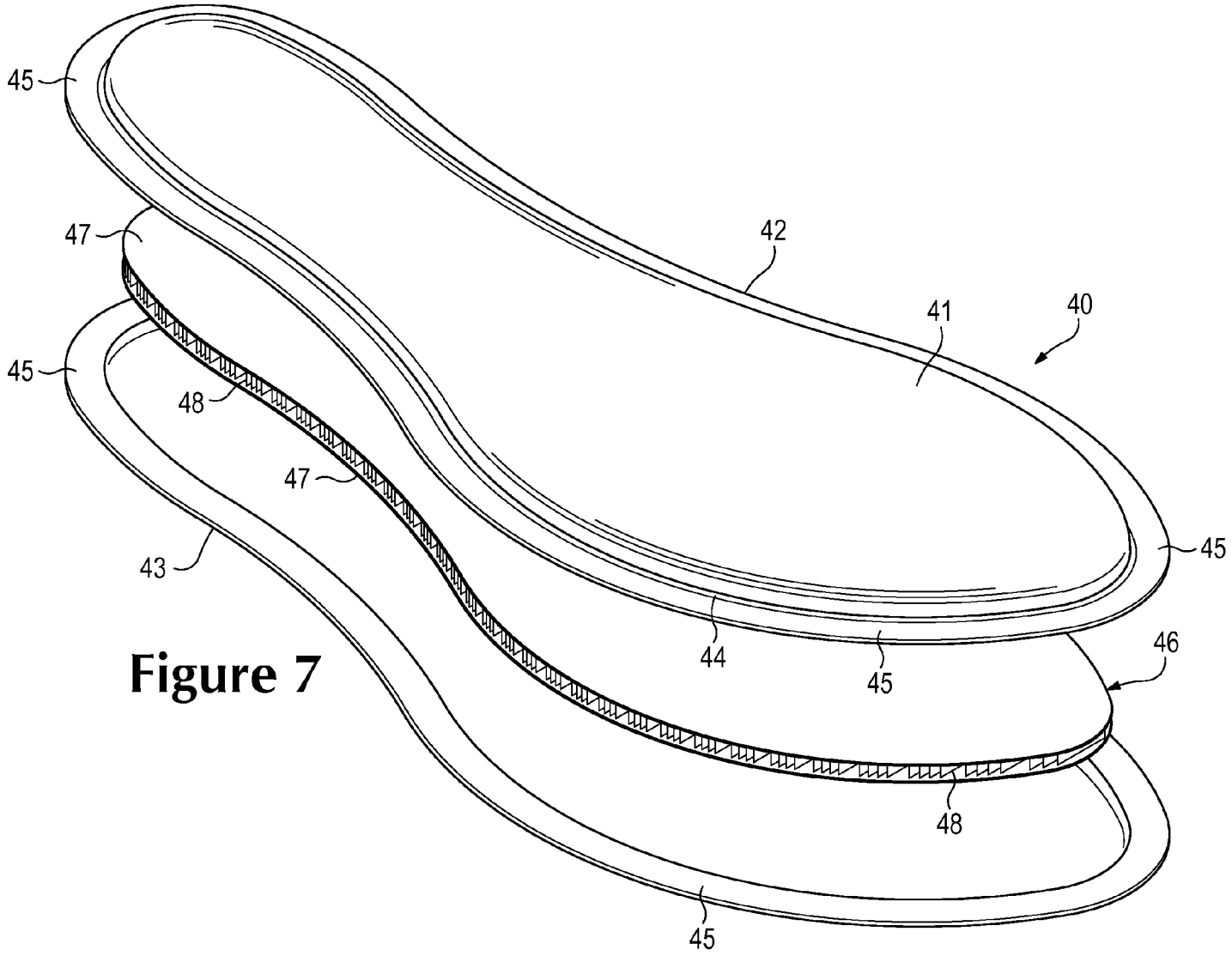
FIG. 7 is an exploded perspective view of the lasting element.
Figure 8:
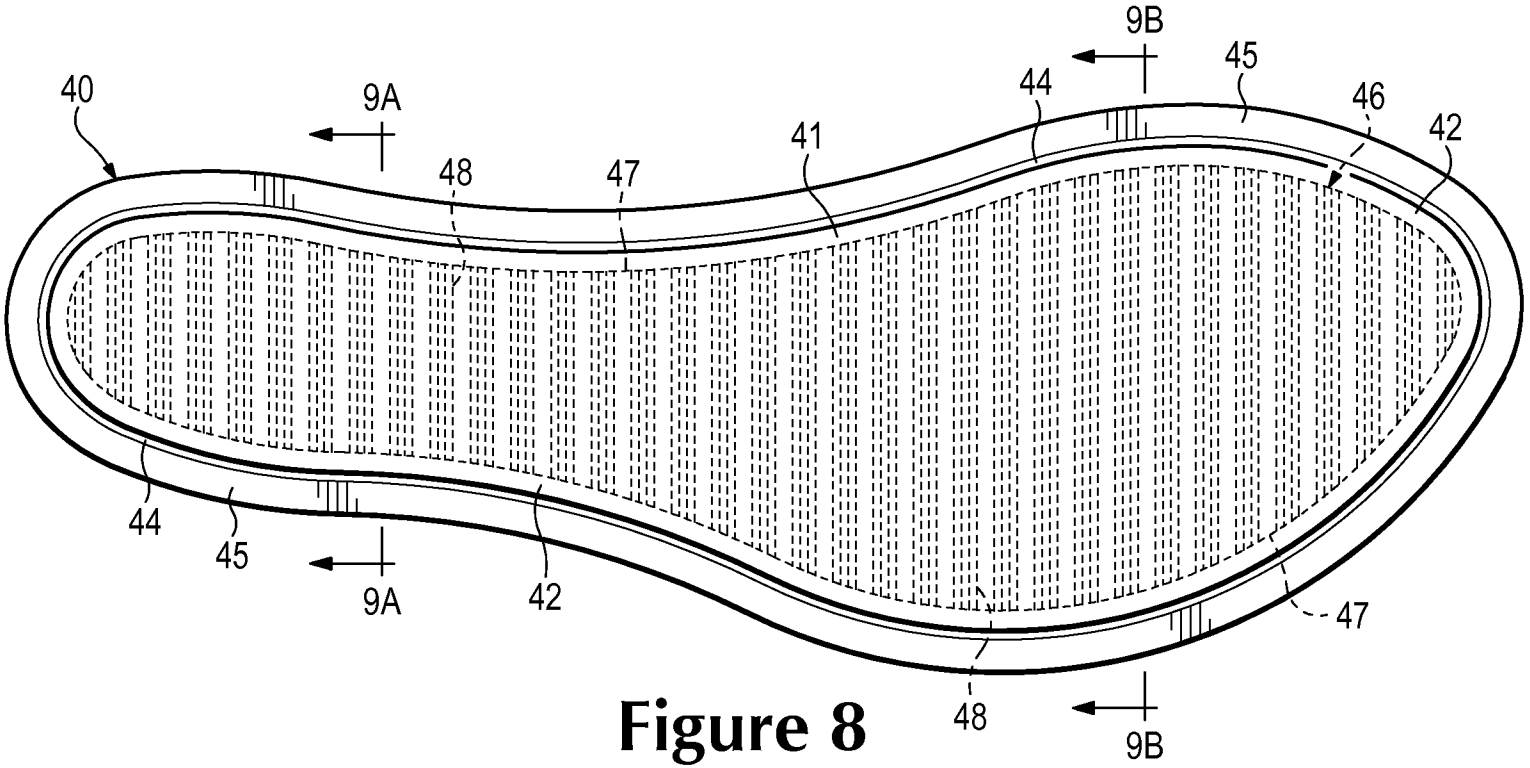
FIG. 8 is a plan view of the lasting element.
Figure 9A:
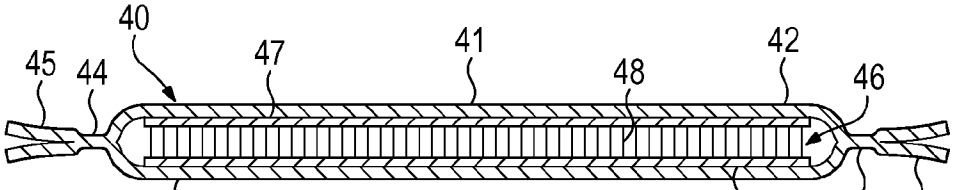
FIGS. 9A and 9B are cross-sectional views of the lasting element, as respectively defined by section lines 9A and 9B in FIG. 8.
Figure 9B:
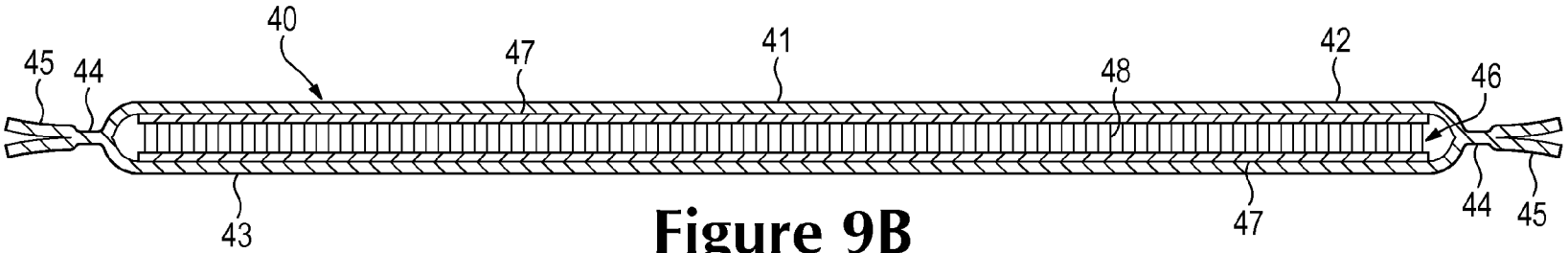
Figure 13A:
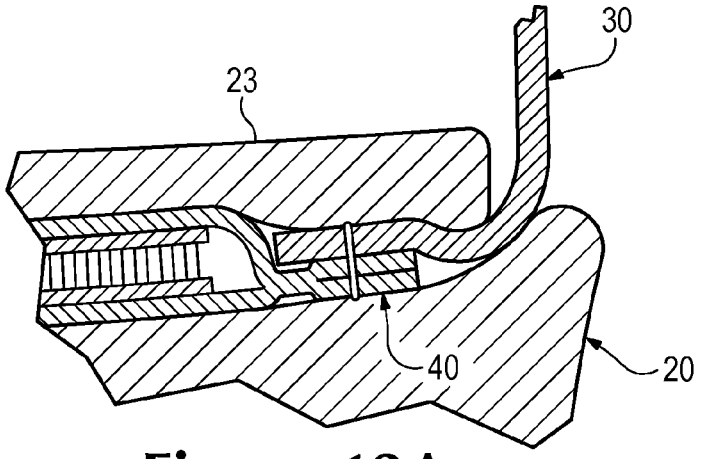
FIGS. 13A-13C are cross-sectional views corresponding with a portion of FIG. 5A and depicting further configurations of the article of footwear.
Figure 13B:
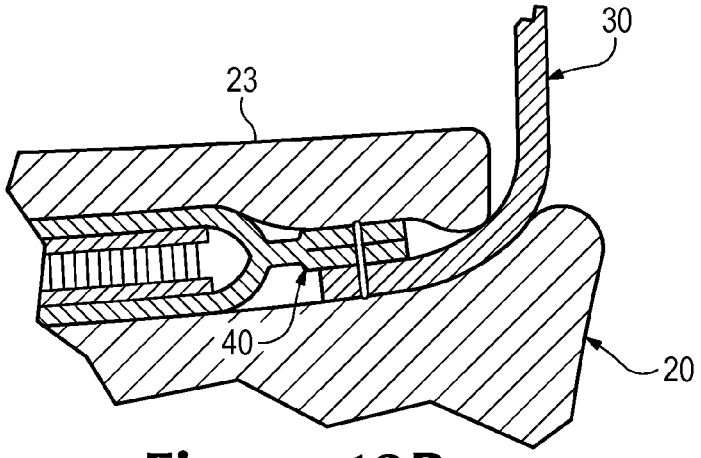
Figure 13C:
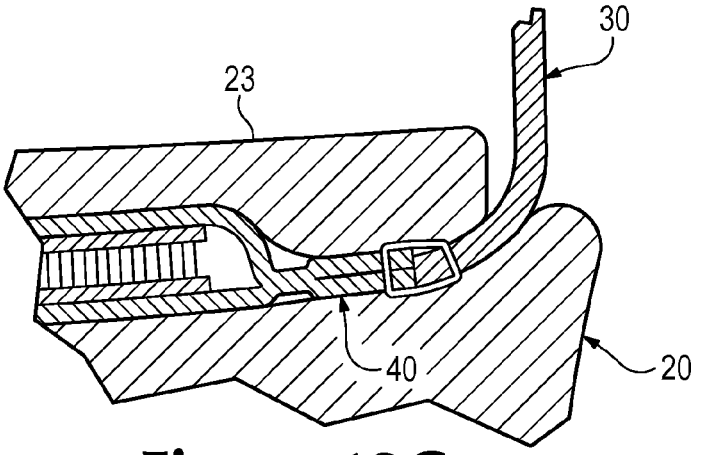

Referring to FIGS. 5A, 5B, and 11E, flange 45 is depicted as overlapping perimeter edge 34 such that (a) a portion of flange 45 lays against a surface of upper 30 and (b) another portion of flange 45 extends outward from perimeter edge 34. The placement of lasting element 40 with respect to perimeter edge 34 may vary. In further configurations, flange 45 may be secured to upper 30 such that (a) substantially all of flange 45 lays against the surface of upper 30, as depicted in FIG. 13A, (b) flange 45 lays adjacent to an opposite surface of upper 30, as depicted in FIG. 13B, and (c) an edge of flange 45 is joined to perimeter edge 34, as depicted in FIG. 13C. Accordingly, the manner in which flange 45 is joined to upper 30 may vary.

Figure 14A:
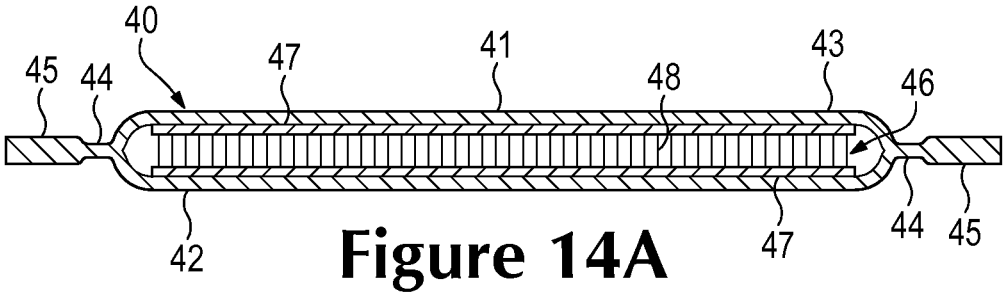
FIGS. 14A-14J are cross-sectional views corresponding with FIG. 9A and depicting further configurations of the lasting element.
Figure 14B:
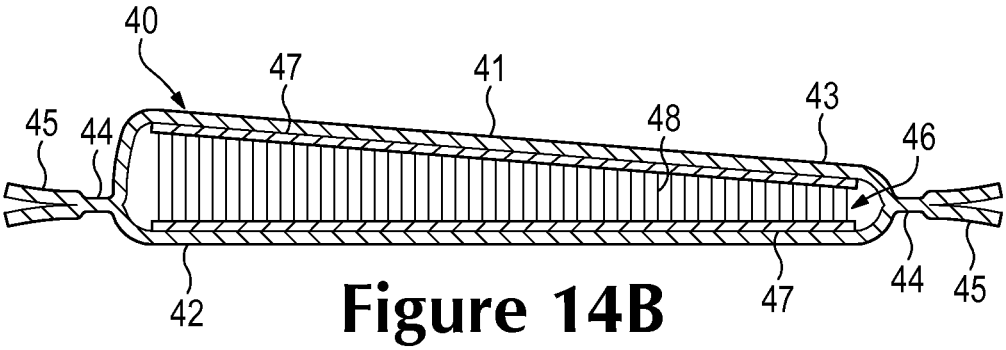
Figure 14C:
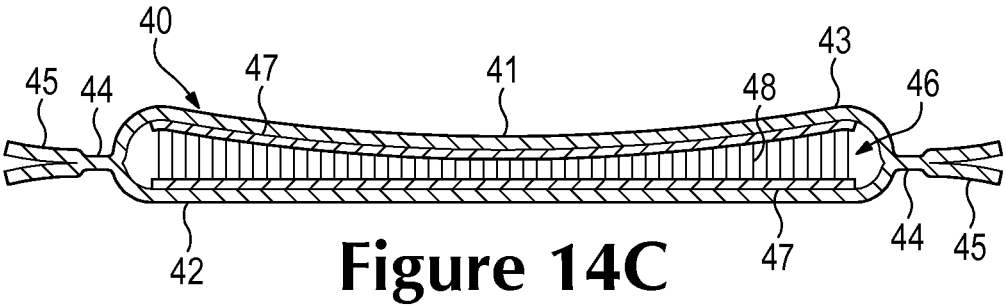
Figure 14D:
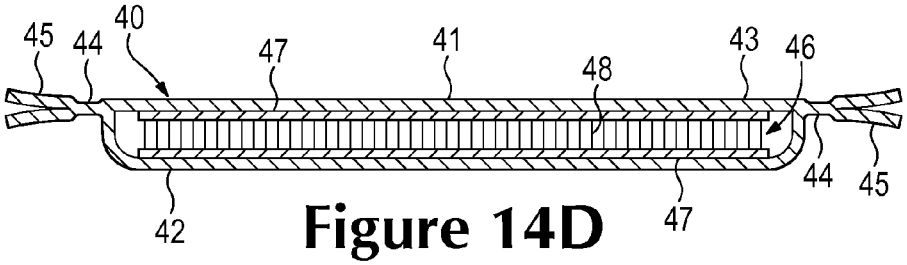
Figure 14E:
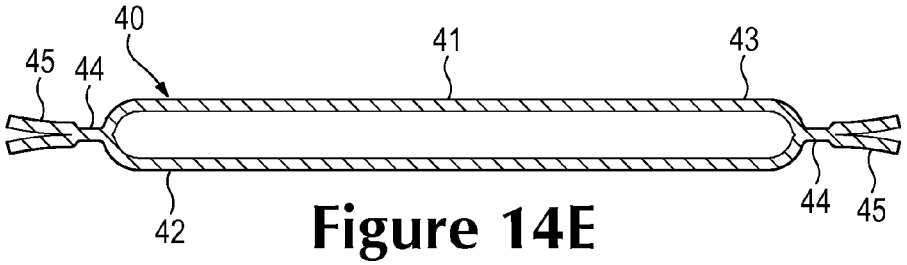
Figure 14F:
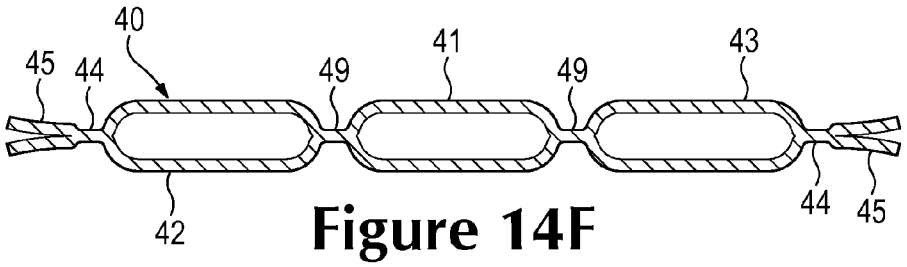

Numerous aspects relating to lasting element 40 may also vary. Referring to FIG. 14A, for example, the polymer layers forming flange 45 are bonded to each other. As another example, lasting element 40 may be contoured to have a tapered configuration, as depicted in FIG. 14B, or to form a depression, as depicted in FIG. 14C. Methods disclosed in U.S. Patent Application Publication Number 2009/0288312 to Dua and U.S. Patent Application Publication Number 2009/0288313 to Rapaport, et al. may be utilized to impart contouring to lasting element 40. In another configuration, the location of peripheral bond 44 may be substantially level with an upper surface of lasting element 40, as depicted in FIG. 14D, rather than centered between upper and lower surfaces. That is, flange 45 is offset from a central area of a sidewall of barrier 41. Although lasting element 40 is discussed as incorporating tensile member 46, tensile member 46 may be absent in some configurations, as depicted in FIG. 14E. In order to prevent lasting element 40 from expanding outward due to the pressure of the fluid within barrier 41, various bonds 49 may be formed between barrier portions 42 and 43, as depicted in FIG. 14F.

Figure 14G:
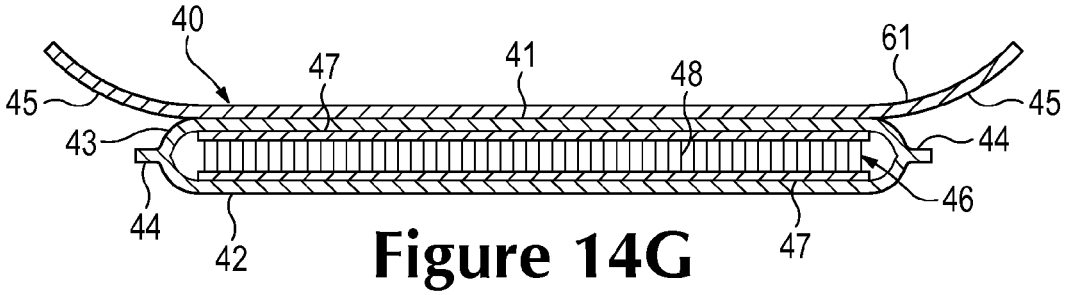
Figure 14H:
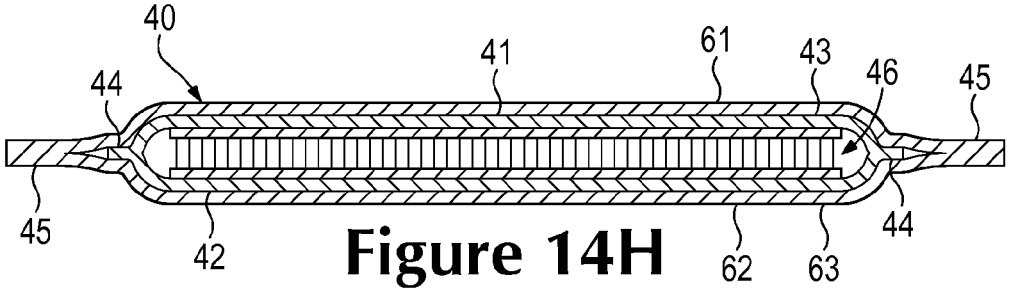

In the various configurations discussed above, flange 45 is an extension of first barrier portion 42 and second barrier portion 43. That is, flange 45 is formed from the polymer material that forms barrier 41. In other configurations of footwear 10, however, other elements may be bonded to barrier 41 or may extend around barrier 41 to form flange 45. Referring to FIG. 14G, for example, a layer 61 is bonded to second barrier portion 43 and extends outward from barrier 41 to form flange 45. When incorporated into footwear 10, layer 61 may be stitched or otherwise bonded to upper 30 adjacent to perimeter edge 34. As another example, FIG. 14H depicts a configuration wherein a pair of layers 62 and 63 envelop or otherwise extend around barrier 41 to form a flange 45. Layers 62 and 63 may be bonded to barrier portions 42 and 43 or may loosely contact barrier portions 42 and 43. In order to reinforce flange 45 in this configuration, a reinforcing element 64 may be bonded to flange 45, as depicted in FIG. 141. In each of the configurations depicted in FIGS. 14G-14I, layers 61-63 may be polymer sheets or textile elements, for example. Layers 61-63 may also be a non-woven textile element that is formed from the same polymer material as barrier 41, which facilitates bonding between barrier 41 and layers 61-63.

Figure 14I:
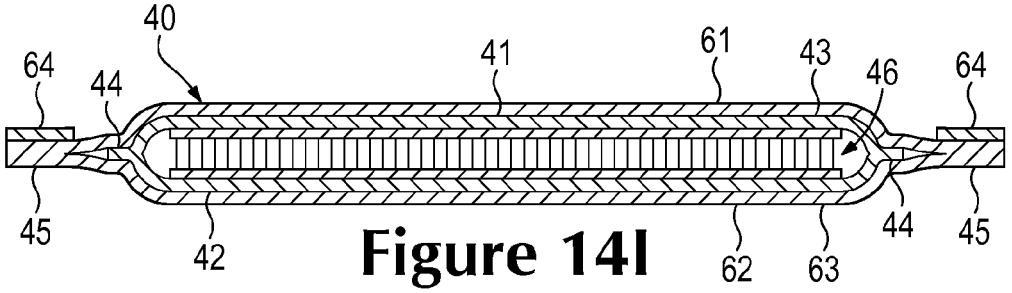

In manufacturing the configurations depicted in FIGS. 14G-14I, barrier 41 may be formed and pressurized and then layers 61-63 may be secured to barrier 41 through the application of heat and pressure. As an alternative, any of layers 61-63 may be located within the mold that forms barrier 41, thereby securing layers 61-63 to barrier 41 during the manufacturing process. In order to inhibit bonding in specific areas, polytetrafluoroethylene or other blocking materials may be utilized.

Figure 14J:
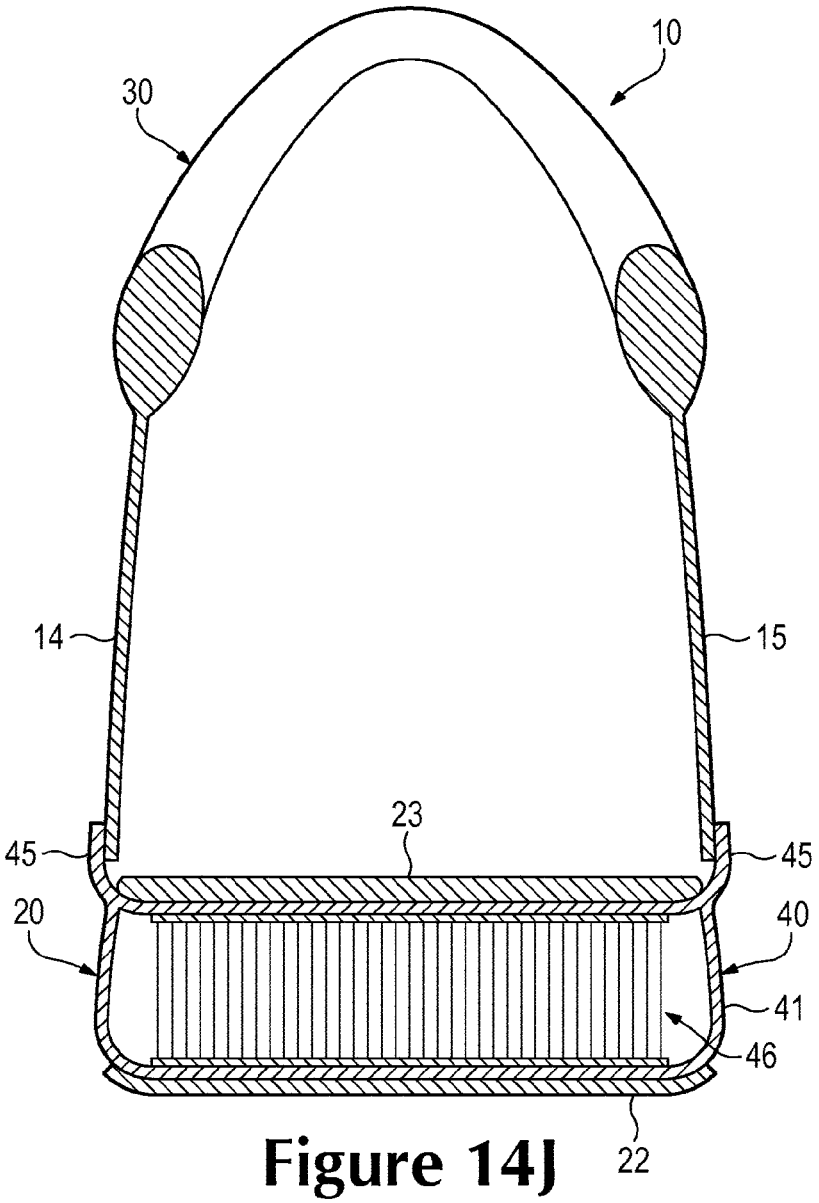

A further configuration is depicted in FIG. 14J, wherein outsole 22 and sockliner 23 are bonded to lasting element 40. In this configuration, the combination of outsole 22, sockliner 23, and lasting element 40 substantially forms sole structure 20. That is, the polymer foam element forming midsole 21 is absent. Depending upon the manufacturing process that is utilized for lasting element 40, outsole 22 and sockliner 23 may be bonded to lasting element 40 during manufacturing. That is, outsole 22 and sockliner 23 may be placed within the mold forming lasting element 40 and bonded to lasting element 40 during the manufacturing process. The combination of outsole 22, sockliner 23, and lasting element 40, which forms sole structure 20, may then be joined to upper 30. The general concept of placing elements within a mold and bonding the elements to a fluid-filed chamber is disclosed in U.S. Patent Application Publication Number 2009/0151093 to Schindler, et al. As an alternative for this configuration, outsole 22 and sockliner 23 may be bonded, adhered, or welded to lasting element 40 following the manufacture of lasting element 40. Also note that this configuration exposes an area of a sidewall of lasting element 40 to an exterior of footwear 10. That is, lasting element 40 is visible on an exterior of footwear 10, which may enhance the aesthetic appeal of footwear 10.

Referring again to the configuration of FIG. 14J, sockliner 23 may be replaced by a midsole element formed from polymer foam or another compressible material. The midsole element may, for example, be removable to allow different individuals to insert midsole elements having different properties. In some configurations, sockliner 23 or the midsole element may also include a plate or other structure. As a similar concept, a bootie or other foot-receiving member may be located within the void in upper 30, and a lower area of the bootie may incorporate sockliner 23 or a midsole element. Accordingly, the configuration of FIG. 14J may be utilized in footwear styles where elements (e.g., sockliners, midsole elements, booties) are located within upper 30 and supplement the force attenuation properties of lasting element 40.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A method of manufacturing an article of footwear, the method comprising:

assembling at least a portion of an upper of the article of footwear, the upper having a lower perimeter edge;

securing a lasting element to the upper adjacent to the lower perimeter edge, the lasting element including a pressurized barrier and a tensile member located within the barrier, the tensile member being secured to opposite sides of the barrier; and joining a sole structure of the article of footwear to at least one of the upper and the lasting element;

wherein the step of securing the lasting element to the upper includes joining a flange that extends around a perimeter of the barrier to the upper.

2. The method recited in claim 1, wherein a peripheral bond extends between the flange and the barrier, and the flange extends outward from the peripheral bond for a distance ranging from 5 to 15 millimeters.

3. The method recited in claim 1, further including a step of forming the flange to be a portion of a material forming the barrier.

4. The method recited in claim 1, further including a step of forming the flange to be a separate element from a material forming the barrier.

5. The method recited in claim 1, wherein the step of securing the lasting element to the upper includes stitching the flange to the upper.

6. The method recited in claim 1, wherein the step of securing the lasting element to the upper includes extending the lasting element from a forefoot region to a heel region of the upper.

7. The method recited in claim 1, wherein the step of joining the sole structure to the upper includes bonding the sole structure to at least one of the upper and the lasting element.

8. The method recited in claim 1, further including a step of forming the lasting element such that the tensile member is a spacer textile.

9. The method recited in claim 1, further including a step of placing the upper over a last having a shape of a foot.

10. A method of manufacturing an article of footwear, the method comprising:

placing at least a portion of an upper of the article of footwear over a last, the upper having a lower perimeter edge;

positioning a lasting element adjacent to the lower perimeter edge, the lasting element including (a) an outer barrier formed of a polymer material that defines an interior void, (b) a flange formed from the polymer material and extending around at least a portion of the barrier, and (c) a tensile member located within the interior void and bonded to opposite sides of the barrier, the tensile member being formed from a textile element that includes a pair of spaced layers joined by a plurality of connecting members;

securing the flange of the lasting element to the upper adjacent to the lower perimeter edge; and joining a sole structure of the article of footwear to the upper.

11. The method recited in claim 10, wherein the step of securing the flange includes stitching the flange to the upper adjacent to the lower perimeter edge.

12. The method recited in claim 10, wherein the step of securing the lasting element to the upper includes extending the lasting element from a forefoot region to a heel region of the upper.

13. The method recited in claim 10, wherein the step of joining the sole structure to the upper includes bonding the sole structure to at least one of the upper and the lasting element.

14. The method recited in claim 10, further including a step of forming the lasting element such that the tensile member is a spacer textile.

15. The method recited in claim 10, further including a step of forming the lasting element to have a contoured configuration.

16. The method recited in claim 15, wherein the contoured configuration is one of a taper and a depression in the lasting element.

17. The method recited in claim 10, further including a step of forming the lasting element to have the flange offset from a central area of a sidewall of the barrier.

18. An article of footwear comprising:

an upper for receiving a foot of a wearer, the upper defining a lower perimeter edge;

a chamber having (a) an outer barrier formed of a polymer material that defines an interior void, (b) a flange formed from the polymer material and extending around at least a portion of the barrier, the flange being secured to the upper adjacent to the lower perimeter edge, and (c) a tensile member located within the interior void and bonded to opposite sides of the barrier; and an outsole secured to a lower surface of the chamber.

19. The article of footwear recited in claim 18, wherein a sidewall of the chamber is exposed to an exterior of the footwear.

20. The article of footwear recited in claim 18, wherein a sockliner is secured to an upper surface of the chamber, the upper surface being located opposite the lower surface.

21. The article of footwear recited in claim 20, wherein the flange is located at the upper surface.

22. The article of footwear recited in claim 18, wherein the tensile member is a spacer textile.

23. The article of footwear recited in claim 18, wherein a peripheral bond extends between the flange and the barrier, and the flange extends outward from the peripheral bond for a distance ranging from 5 to 15 millimeters.

24. The article of footwear recited in claim 18, wherein a pressurized fluid is located within the interior void of the chamber.

* * * * *